US009523522B2

(12) United States Patent
Chou et al.

(10) Patent No.: US 9,523,522 B2
(45) Date of Patent: Dec. 20, 2016

(54) REFRIGERATION DEVICES INCLUDING TEMPERATURE-CONTROLLED CONTAINER SYSTEMS

(71) Applicant: Tokitae LLC, Bellevue, WA (US)

(72) Inventors: Fong-Li Chou, Bellevue, WA (US); Philip A. Eckhoff, Kirkland, WA (US); Lawrence Morgan Fowler, Kirkland, WA (US); William Gates, Medina, WA (US); Jennifer Ezu Hu, Seattle, WA (US); Muriel Y. Ishikawa, Livermore, CA (US); Fridrik Larusson, Seattle, WA (US); Shieng Liu, Bellevue, WA (US); Nathan P. Myhrvold, Medina, WA (US); Brian L. Pal, Medina, WA (US); Nels R. Peterson, Bellevue, WA (US); David Keith Piech, Seattle, WA (US); Maurizio Vecchione, Pacific Palisades, CA (US); Lowell L. Wood, Jr., Bellevue, WA (US); Victoria Y. H. Wood, Livermore, CA (US); David J. Yager, Carnation, WA (US)

(73) Assignee: Tokitae LLC, Bellevue, WA (US)

( * ) Notice: Subject to any disclaimer, the term of this patent is extended or adjusted under 35 U.S.C. 154(b) by 59 days.

(21) Appl. No.: 14/704,107

(22) Filed: May 5, 2015

(65) Prior Publication Data

US 2015/0233617 A1 Aug. 20, 2015

Related U.S. Application Data

(63) Continuation-in-part of application No. 14/484,969, filed on Sep. 12, 2014, which is a continuation-in-part (Continued)

(51) Int. Cl.
*F25B 39/02* (2006.01)
*F25B 49/02* (2006.01)

(52) U.S. Cl.
CPC ..... *F25B 39/028* (2013.01); *F25B 49/02* (2013.01); *F25B 2339/02* (2013.01)

(58) Field of Classification Search
CPC ..... F25B 39/028; F25B 49/02; F25B 2339/02; F25B 39/00; F25B 39/04

(Continued)

(56) References Cited

U.S. PATENT DOCUMENTS 4,137,964 A 2/1979 Buckley
4,474,170 A 10/1984 McConnell et al.

(Continued)

FOREIGN PATENT DOCUMENTS

EP 0 098 052 A2 1/1984
WO WO 2011/007162 A1 1/2011

(Continued)

OTHER PUBLICATIONS

U.S. Appl. No. 14/484,969, Chou et al.

(Continued)

*Primary Examiner* — Mohammad M Ali

(57) ABSTRACT

In some embodiments, a refrigeration device includes: walls substantially forming a liquid-impermeable container configured to hold phase change material internal to a refrigeration device; at least one active refrigeration unit including a set of evaporator coils positioned within an interior of the liquid-impermeable container; walls substantially forming a storage region; and a heat transfer system including a first group of vapor-impermeable structures with a hollow interior connected to form a condenser in thermal contact with the walls substantially forming a liquid-impermeable container, a second group of vapor-impermeable structures with (Continued)

a hollow interior connected to form an evaporator in thermal contact with the walls substantially forming a storage region, and a connector with a hollow interior affixed to both the condenser and the evaporator, the connector forming a liquid and vapor flow path between the hollow interior of the condenser and the hollow interior of the evaporator.

43 Claims, 8 Drawing Sheets

Related U.S. Application Data of application No. 14/091,831, filed on Nov. 27, 2013, now Pat. No. 9,366,483.

(58) Field of Classification Search
USPC ..... 62/190, 440
See application file for complete search history.

(56) References Cited

U.S. PATENT DOCUMENTS 5,251,455 A * 10/1993 Cur ..... F25B 5/02 62/199
5,497,630 A 3/1996 Stein et al.
5,579,830 A 12/1996 Giammaruti
8,716,689 B2 5/2014 Chen et al.
2011/0016886 A1 1/2011 Ghoshal et al.
2011/0265785 A1 11/2011 Klier et al.
2012/0012804 A1 1/2012 Chen et al.
2012/0192574 A1 8/2012 Ghoshal et al.
2012/0292476 A1 11/2012 Smith et al.
2012/0294407 A1 11/2012 Namba et al.
2013/0019623 A1 1/2013 Jo et al.
2013/0047652 A1 2/2013 Lee et al.
2013/0063854 A1 3/2013 Soffer
2013/0152621 A1 6/2013 Lee et al.
2013/0160476 A1 6/2013 Lee et al.
2013/0160484 A1 6/2013 Lee et al.

FOREIGN PATENT DOCUMENTS

WO WO 2013/110957 A2 8/2013
WO WO 2013/165535 A1 11/2013

OTHER PUBLICATIONS

U.S. Appl. No. 14/091,831, Eckhoff et al.
PCT International Search Report; International App. No. PCT/US2014/067273; bearing a date of Apr. 24, 2015; pp. 1-3.
PCT International Search Report; International App. No. PCT/US2016/030658; Aug. 11, 2016; pp. 1-3.

* cited by examiner

REFRIGERATION DEVICES INCLUDING TEMPERATURE-CONTROLLED CONTAINER SYSTEMS

PRIORITY APPLICATIONS

The present application constitutes a continuation-in-part of U.S. patent application Ser. No. 14/484,969, entitled REFRIGERATION DEVICES INCLUDING TEMPERATURE-CONTROLLED CONTAINER SYSTEMS, naming Fong-Li Chou, Philip A. Eckhoff, Lawrence Morgan Fowler, William Gates, Jennifer Ezu Hu, Muriel Y. Ishikawa, Fridrik Larusson, Shieng Liu, Nathan P. Myhrvold, Nels R. Peterson, Clarence T. Tegreene, Maurizio Vecchione, Lowell L. Wood, Jr., and Victoria Y. H. Wood as inventors, filed 12 Sep. 2014, which is currently co-pending or is an application of which a currently co-pending application is entitled to the benefit of the filing date, and which is a continuation-in-part of U.S. patent application Ser. No. 14/091,831, entitled TEMPERATURE-CONTROLLED CONTAINER SYSTEMS FOR USE WITHIN A REFRIGERATION DEVICE, naming Philip A. Eckhoff, Lawrence Morgan Fowler, William Gates, Jennifer Ezu Hu, Muriel Y. Ishikawa, Nathan P. Myhrvold, Nels R. Peterson, Clarence T. Tegreene, Maurizio Vecchione, Lowell L. Wood, Jr., and Victoria Y. H. Wood as inventors, filed 27 Nov. 2013.

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)).

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In some embodiments, a refrigeration device includes: one or more walls substantially forming a liquid-impermeable container, the liquid-impermeable container configured to hold phase change material internal to a refrigeration device; at least one active refrigeration unit including a set of evaporator coils, the evaporator coils positioned within an interior of the liquid-impermeable container; one or more walls substantially forming a storage region; and a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector with a hollow interior affixed to both the condenser and the evaporator, the connector forming a liquid and vapor flow path between the hollow interior of the condenser and the hollow interior of the evaporator.

In some embodiments, a refrigeration device includes: one or more walls substantially forming a liquid-impermeable container, the container configured to hold phase change material internal to a refrigeration device, wherein the one or more walls integrally include a first group of vapor-impermeable structures with a hollow interior connected to form a condenser; at least one active refrigeration unit including a set of evaporator coils, the evaporator coils positioned within an interior of the liquid-impermeable container; one or more walls substantially forming a storage region and integrally including a second group of vapor-impermeable structures with a hollow interior connected to form a evaporator; and a connector affixed to both the condenser and the evaporator, the connector forming a liquid and vapor flow path between the hollow interior of the condenser and the hollow interior of the evaporator, wherein the condenser, the evaporator and the connector form a heat transfer system integral to the refrigeration device.

In some embodiments, a refrigeration device includes: one or more walls substantially forming a liquid-impermeable container, the container configured to hold phase change material internal to a refrigeration device; at least one active refrigeration unit including a set of evaporator coils, the evaporator coils positioned within an interior of the liquid-impermeable container; a sensor positioned within the liquid-impermeable container between the one or more walls and the set of evaporator coils; one or more walls substantially forming a storage region; a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector affixed to both the condenser and the evaporator, the connector forming a liquid and vapor flow path between the hollow interior of the condenser and the hollow interior of the evaporator; and a controller operably attached to the at least one active refrigeration unit and to the sensor.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
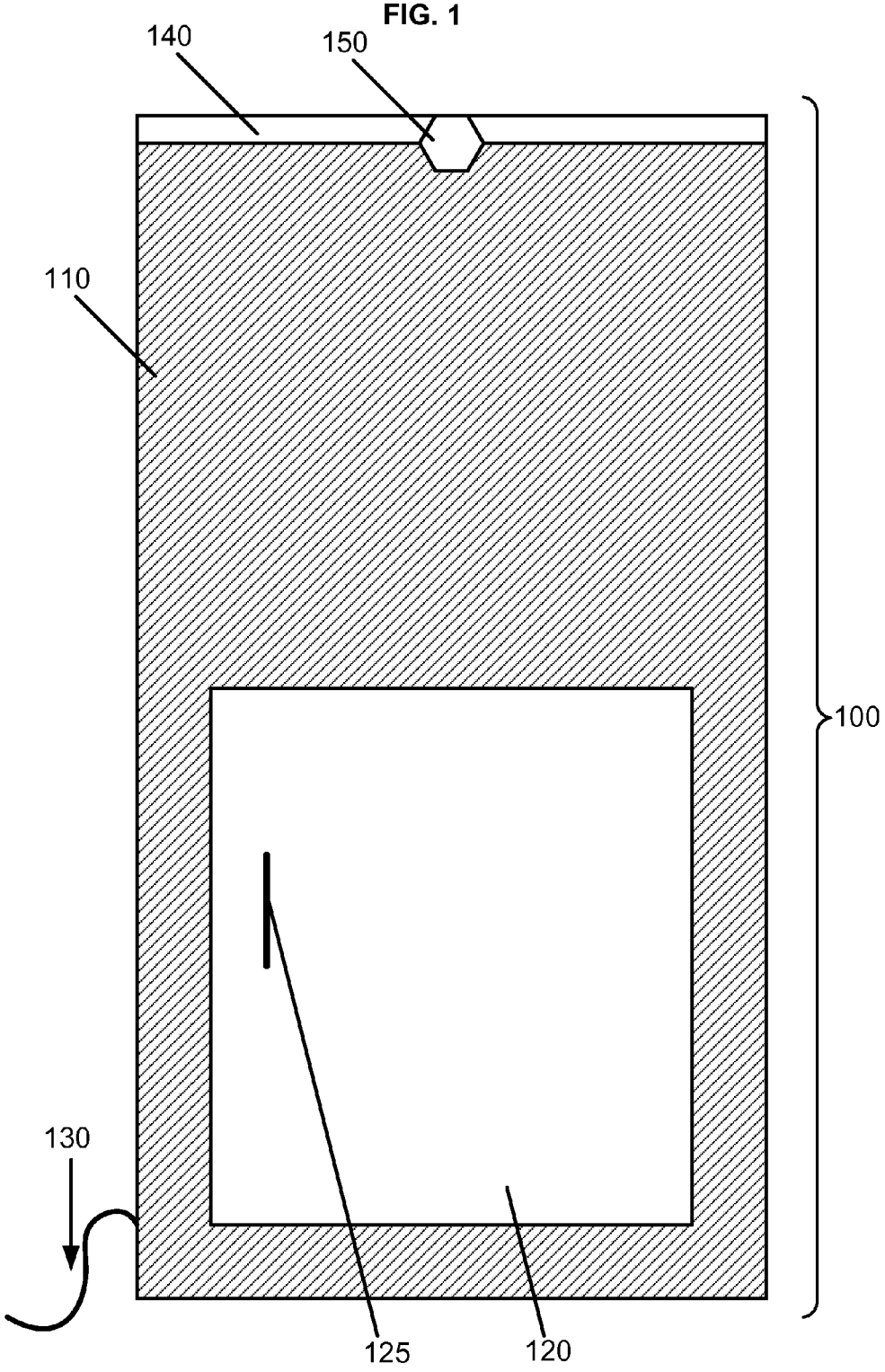
FIG. 1 is a schematic of a refrigeration device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Aspects of refrigeration devices are described herein. For example, in some embodiments, refrigeration devices are of a size, shape and configuration to be used as a domestic refrigerator device. For example, in some embodiments, refrigeration devices are of a size, shape and configuration for use as a domestic refrigerator appliance. For example, in some embodiments, refrigeration devices are of a size, shape and configuration for use as a commercial refrigerator device. For example, in some embodiments, refrigeration devices are of a size, shape and configuration for use as a medical refrigerator device, such as in a clinic or health outpost in a region with uncertain or intermittent power supply.

The refrigeration devices described herein are configured to provide ongoing temperature control to at least one storage region within each refrigeration device. The refrigeration devices described herein are designed to provide ongoing temperature control to at least one storage region within the refrigeration devices even in times when a refrigeration device is not able to operate based on the usual power supply, for example during power outages. In particular, it is envisioned that the refrigeration devices described herein will be useful in locations with intermittent or variable power supply to refrigeration devices. For example, in some embodiments, refrigeration devices can be configured to maintain the internal storage region or regions within a predetermined temperature range indefinitely while the refrigeration device has access to electrical power approximately 10% of the time on average. For example, in some embodiments, refrigeration devices can be configured to maintain the internal storage region or regions within a predetermined temperature range indefinitely while the refrigeration device has access to electrical power approximately 5% of the time on average. For example, in some embodiments, refrigeration devices can be configured to maintain the internal storage region or regions within a predetermined temperature range indefinitely while the refrigeration device has access to electrical power approximately 1% of the time on average. For example, in some embodiments, refrigeration devices can be configured to maintain the internal storage region or regions within a predetermined temperature range for at least 30 hours. For example, in some embodiments, refrigeration devices can be configured to maintain the internal storage region or regions within a predetermined temperature range for at least 50 hours. For example, in some embodiments, refrigeration devices can be configured to maintain the internal storage region or regions within a predetermined temperature range for at least 70 hours. For example, in some embodiments, refrigeration devices can be configured to maintain the internal storage region or regions within a predetermined temperature range for at least 90 hours. For example, in some embodiments, refrigeration devices can be configured to maintain the internal storage region or regions within a predetermined temperature range for at least 110 hours. For example, in some embodiments, refrigeration devices can be configured to maintain the internal storage region or regions within a predetermined temperature range for at least 130 hours. For example, in some embodiments, refrigeration devices can be configured to maintain the internal storage region or regions within a predetermined temperature range for at least 150 hours. For example, in some embodiments, refrigeration devices can be configured to maintain the internal storage region or regions within a predetermined temperature range for at least 170 hours.

Items that are sensitive to temperature extremes can be stored within the storage region or regions of refrigeration devices in order to maintain the items within a predetermined temperature range for extended periods, even when power supply to the refrigeration device is interrupted. For example, in some embodiments, a refrigeration device that is unable to obtain power is configured to maintain the temperature of its internal storage region or regions within a predetermined temperature range for an extended period of time when the ambient external temperature is between −10° C. and 43° C. For example, in some embodiments, a refrigeration device that is unable to obtain power is configured to maintain the temperature of its internal storage region or regions within a predetermined temperature range for a period of time when the ambient external temperature is between 25° C. and 43° C. For example, in some embodiments, a refrigeration device that is unable to obtain power is configured to maintain the temperature of its internal storage region or regions within a predetermined temperature range for a period of time when the ambient external temperature is between 35° C. and 43° C. For example, in some embodiments, a refrigeration device that is unable to obtain power is configured to maintain the temperature of its internal storage region or regions within a predetermined temperature range for at least one week when the ambient external temperature is between −35° C. and 43° C. For example, in some embodiments, a refrigeration device that is unable to obtain power is configured to maintain the temperature of its internal storage region or regions within a predetermined temperature range for at least two weeks when the ambient external temperature is between −35° C. and 43° C. For example, in some embodiments, a refrigeration device that is unable to obtain power is configured to maintain the temperature of its internal storage region or regions within a predetermined temperature range for at least 30 days when the ambient external temperature is between −35° C. and 43° C. For example, in some embodiments, a refrigeration device that is unable to obtain power is configured to maintain the temperature of its internal storage region or regions within a predetermined temperature range for a period of time when the ambient external temperature is below −10° C.

As used herein, a "refrigeration device" refers to a device with an internal storage region that utilizes an external power source at least part of the time and is configured to consistently store material at a temperature below ambient temperature for a period of time. In some embodiments, a refrigeration device includes two internal storage regions. In some embodiments, a refrigeration device includes more than two internal storage regions. In some embodiments, a refrigeration device includes two or more internal storage regions, each of the storage regions configured to maintain an internal temperature within a different temperature range. Generally, refrigeration devices include an active refrigeration system. In some embodiments, a refrigeration device is electrically powered from a municipal power supply. In some embodiments, a refrigeration device is powered from a solar power system. In some embodiments, a refrigeration device is powered from a battery. In some embodiments, a refrigeration device is powered from a generator, such as a diesel power generator.

In some embodiments, a refrigeration device is a refrigerator. Refrigerators are generally calibrated to hold internally stored items in a predetermined temperature range above zero but less than potential ambient temperatures. Refrigerators can, for example, be designed to maintain internal temperatures between 1° C. and 4° C. In some embodiments, a refrigeration device is a standard freezer. Freezers are generally calibrated to hold internally stored items in a temperature range below zero but above cryogenic temperatures. Freezers can, for example, be designed to maintain internal temperatures between −23° C. and −17° C., or can, for example, be designed to maintain internal temperatures between −18° C. and −15° C. In some embodiments, a refrigeration device includes both a refrigerator compartment and a freezer compartment. For example, some refrigeration devices include a first internal storage region that consistently maintains refrigerator temperature ranges and a second internal storage region that consistently maintains freezer temperature ranges.

In some embodiments, a refrigeration device is configured to maintain the interior storage region of the refrigeration device within a predetermined temperature range. A "predetermined temperature range," as used herein, refers to a range of temperatures that have been predetermined to be desirable for an interior storage region of a particular embodiment of a refrigeration device in use. A predetermined temperature range is the stable temperature range that an interior storage region of a refrigeration device maintains temperature within during use of the refrigeration device. For example, in some embodiments, a refrigeration device is configured to maintain an interior storage region of the refrigeration device within a predetermined temperature range of approximately 2° C. to 8° C. For example, in some embodiments, a refrigeration device is configured to maintain an interior storage region of the refrigeration device within a predetermined temperature range of approximately 1° C. to 9° C. For example, in some embodiments, a refrigeration device is configured to maintain an interior storage region of the refrigeration device within a predetermined temperature range of approximately −15° C. to −25° C. For example, in some embodiments, a refrigeration device is configured to maintain an interior storage region of the refrigeration device within a predetermined temperature range of approximately −5° C. to −10° C.

For example, in some embodiments, a refrigeration device is configured to maintain an interior storage region of the refrigeration device within the predetermined temperature range for at least 50 hours when power is unavailable to the refrigeration device. For example, in some embodiments, a refrigeration device is configured to maintain an interior storage region of the refrigeration device within the predetermined temperature range for at least 100 hours when power is unavailable to the refrigeration device. For example, in some embodiments, a refrigeration device is configured to maintain an interior storage region of the refrigeration device within the predetermined temperature range for at least 150 hours when power is unavailable to the refrigeration device. For example, in some embodiments, a refrigeration device is configured to maintain an interior storage region of the refrigeration device within the predetermined temperature range for at least 200 hours when power is unavailable to the refrigeration device.

In some embodiments, a refrigeration device is configured to passively maintain its interior storage region or regions within a predetermined temperature range for an extended period of time when power is unavailable to the refrigeration device. In some embodiments, a refrigeration device is configured to maintain its interior storage region or regions within a predetermined temperature range for an extended period of time when minimal electric power is available to the refrigeration device. In some embodiments, a refrigeration device is configured to maintain its interior storage region or regions within a predetermined temperature range for an extended period of time when low-voltage electric power is available to the refrigeration device. In some embodiments, a refrigeration device is configured to maintain its interior storage region or regions within a predetermined temperature range for an extended period of time when variable electric power is available to the refrigeration device. For example, in some embodiments the refrigeration device includes a variable power control system. For example, in some embodiments the refrigeration device includes a battery. In some embodiments the refrigeration device operates passively in the absence of power, and does not include a battery.

With reference now to FIG. 1, shown is an example of a refrigeration device that may serve as a context for introducing one or more processes and/or devices described herein. FIG. 1 depicts a refrigeration device 100 that includes a single storage region internal to the refrigeration device. A single door 120 substantially opens the single storage region of the refrigeration device to outside users of the device. A user of the device can use a handle 125 to open the door 120. The refrigeration device 100 is depicted with the front face of an exterior wall of a shell 110 visible. In some embodiments, there is a single door that provides a user access to multiple storage regions within the refrigeration device, such as a first storage region maintained within a first temperature range and a second storage region maintained within a second temperature range. The refrigeration device 100 depicted in FIG. 1 includes a top door 140 reversibly affixed to the upper surface of the refrigeration device 100 with a latch 150. A top door 140 can, for example, be configured to permit access to a liquid-impermeable container located within the refrigeration device 100, the liquid-impermeable container positioned adjacent to an inner surface of the top door 140. Some embodiments of a refrigeration device can be configured to operate from an electrical power supply, such as a municipal power supply or solar electrical power system. For example, the embodiment of a refrigeration device 100 shown in FIG. 1 includes a power cord 130 to connect with the electrical power supply.

In some embodiments, a refrigeration device includes a shell forming an exterior of the refrigeration device around the liquid-impermeable container, the at least one set of evaporator coils, the thermal conductor and the storage region. In some embodiments, a refrigeration device includes a shell surrounding the liquid-impermeable container, the set of evaporator coils, the one or more walls substantially forming a storage region and the heat transfer system, and a door within the shell, the door positioned to reversibly permit a user to access the storage region. For example, in the embodiment shown in FIG. 1, a shell 110 surrounds the exterior of the visible components of the refrigeration device. A shell can be fabricated from a rigid material, for example a fiberglass material or a metal such as stainless steel or aluminum.

In some embodiments, a refrigeration device includes insulation positioned within the shell. In some embodiments, a refrigeration device includes insulation positioned adjacent to an exterior surface of the storage region. The insulation can be of a size and shape to reversibly mate with the external surfaces of the walls of the liquid-impermeable container and the exterior walls substantially forming a storage region. The insulation is of sufficient thickness, quality and composition to reduce the heat leak from the storage region to the level where it is substantially balanced by the heat transfer through the heat transfer system in a specific embodiment and for the expected use scenarios of that embodiment. For example, in some embodiments the refrigeration device and insulation has a heat leak of approximately 30 W. For example, in some embodiments the refrigeration device and insulation has a heat leak of approximately 25 W. For example, in some embodiments the refrigeration device and insulation has a heat leak of approximately 20 W. For example, in some embodiments the refrigeration device and insulation has a heat leak of approximately 15 W. For example, in some embodiments the refrigeration device and insulation has a heat leak of approximately 10 W. For example, in some embodiments the insulation is fabricated from a foam insulation. For example, in some embodiments the insulation is fabricated from vacuum insulated panels ("VIP").

Figure 2:
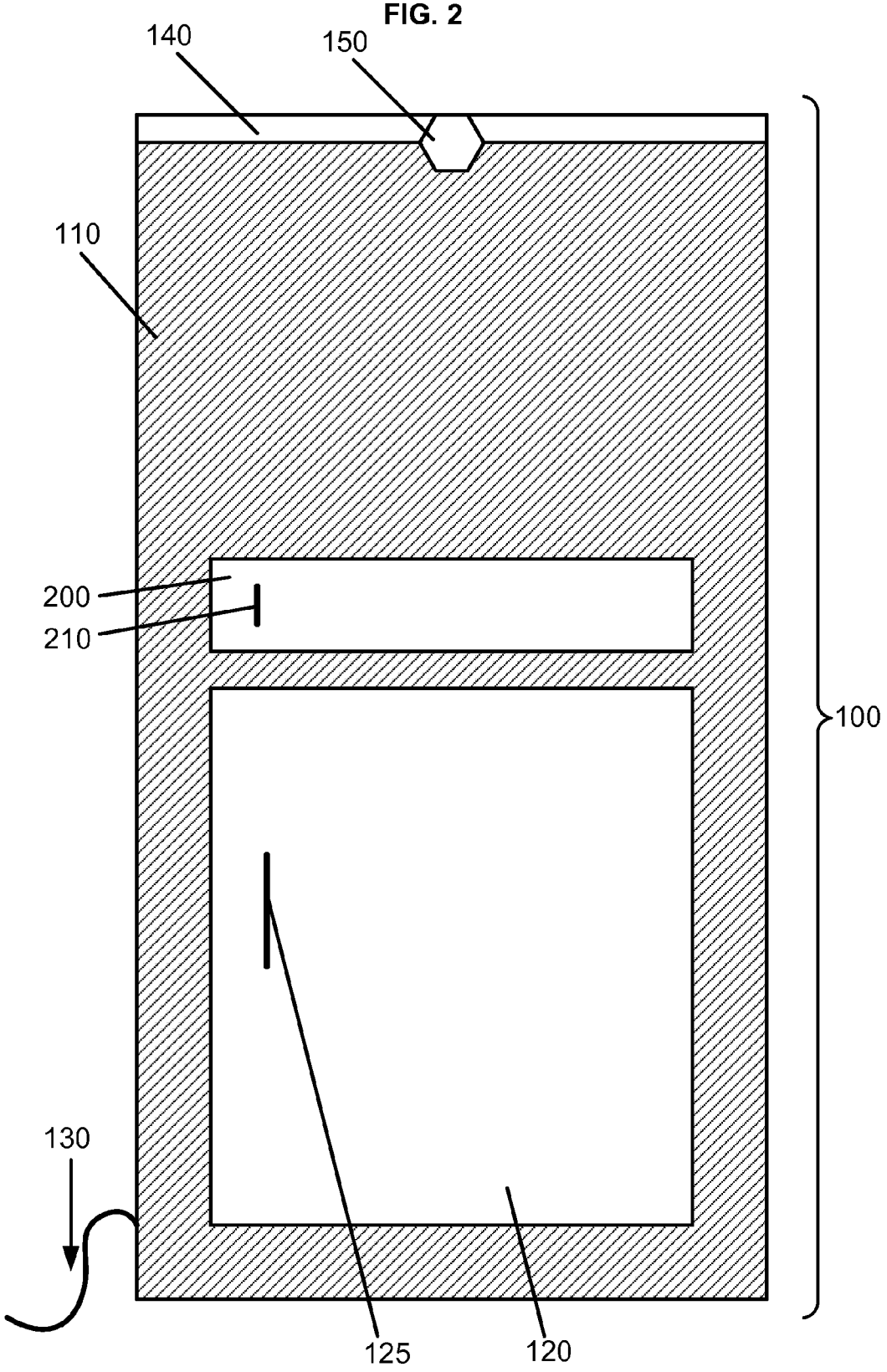
FIG. 2 is a schematic of a refrigeration device.

FIG. 2 depicts a refrigeration device 100 that includes dual storage regions internal to the refrigeration device. The refrigeration device 100 is depicted with the front face of an exterior wall 110 visible. A first door 120 substantially opens the first storage region of the refrigeration device to outside users of the device. A user of the device can use a handle 125 to open the first door 120. In some embodiments, a first storage region can be configured to maintain an internal temperature ten degrees or less above freezing (i.e. 0 degrees Centigrade). In some embodiments, a first storage region can be configured to maintain, for example, an internal temperature in a range between approximately 0 degrees Centigrade and approximately 10 degrees Centigrade. In some embodiments, a first storage region can be configured to maintain, for example, an internal temperature in a range between approximately 1 degree Centigrade and approximately 9 degrees Centigrade. In some embodiments, a first storage region can be configured to maintain, for example, an internal temperature in a range between approximately 2 degrees Centigrade and approximately 8 degrees Centigrade. The embodiment shown in FIG. 2 also includes a second door 200 with a handle 210 to provide access to a user to a second storage region interior to the refrigeration device. In some embodiments, a second storage region can be configured to maintain an internal temperature twenty degrees or more below freezing. In some embodiments, a second storage region can be configured to maintain, for example, an internal temperature in a range between approximately −15 degrees Centigrade and approximately −20 degrees Centigrade. In some embodiments, a second storage region can be configured to maintain, for example, an internal temperature in a range between approximately −10 degrees Centigrade and approximately −5 degrees Centigrade. In some embodiments, a second storage region can be configured to maintain, for example, an internal temperature of approximately 0 degrees Centigrade. In some embodiments, a second storage region can be configured for the storage and freezing of one or more phase change material freezer containers, such as medical-use ice packs. The refrigeration device 100 shown in FIG. 2 includes a top door 140 reversibly affixed to the upper surface of the refrigeration device 100 with a latch 150. The top door 140 can, for example, be configured to allow a user to access a liquid-impermeable container within the refrigeration device 100, the liquid-impermeable container located adjacent to an inner surface of the top door 140. Some embodiments of a refrigeration device can be configured to operate from an electrical power supply, such as a municipal power supply or solar electrical power system. For example, the embodiment of a refrigeration device 100 shown in FIG. 2 includes a power cord 130 to connect with the electrical power supply.

In some embodiments, a refrigeration device includes: one or more walls substantially forming a liquid-impermeable container, the liquid-impermeable container configured to hold phase change material internal to a refrigeration device; at least one active refrigeration unit including a set of evaporator coils, the evaporator coils positioned within an interior of the liquid-impermeable container; one or more walls substantially forming a storage region; a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector with a hollow interior affixed to both the condenser and the evaporator, the connector forming a liquid and vapor flow path between the hollow interior of the condenser and the hollow interior of the evaporator.

Figure 3:
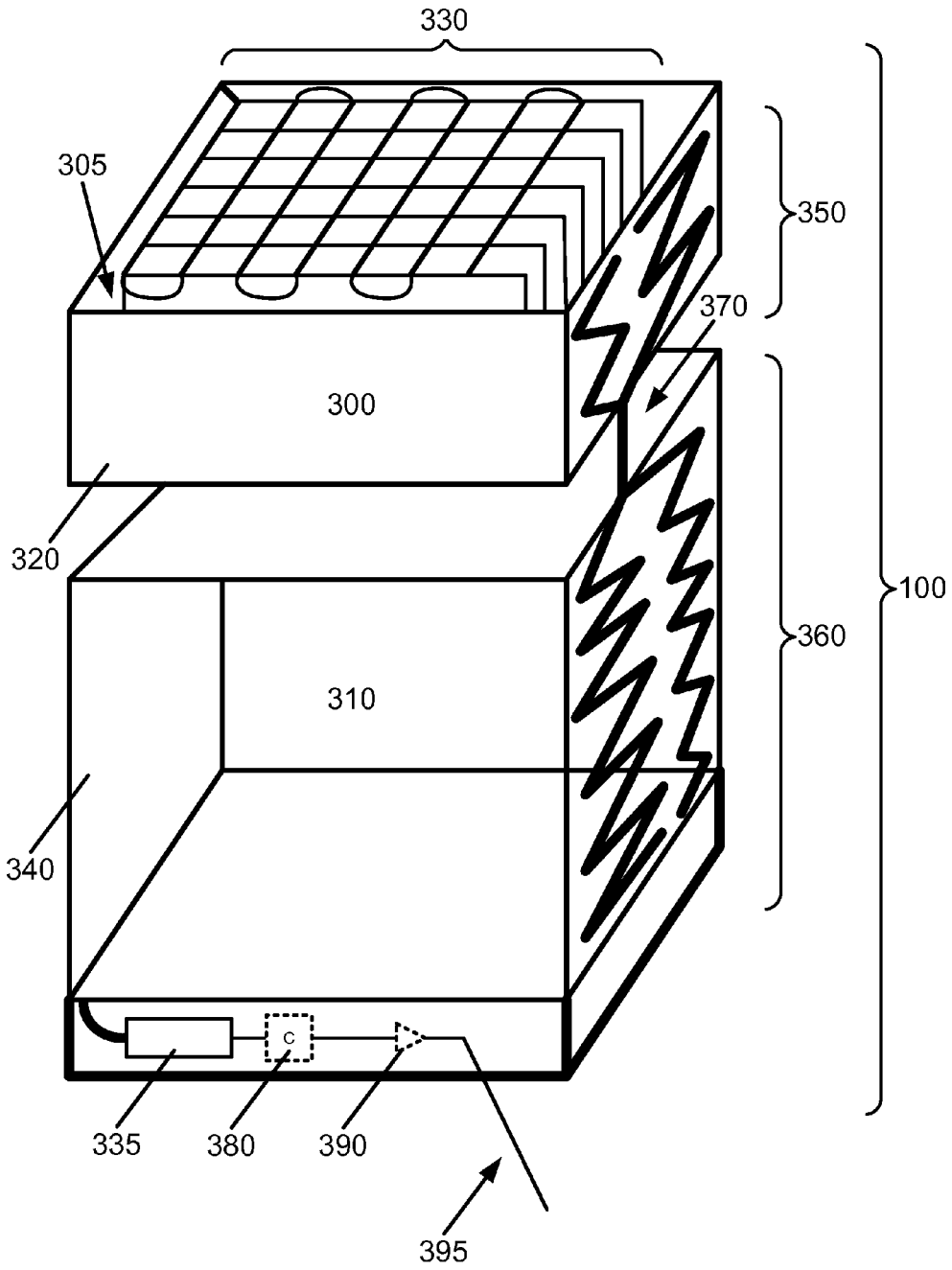
FIG. 3 is a schematic of a refrigeration device.

FIG. 3 depicts a refrigeration device 100 including a liquid-impermeable container 300 configured to hold phase change material internal to the refrigeration device 100 and a storage region 310. For illustration purposes, features of the refrigeration device 100 such as a shell, door(s) and/or a cover (see, e.g. FIGS. 1 and 2) to the refrigeration device 100 are not depicted in FIG. 3, however embodiments can include these and other features. In some embodiments, a liquid-impermeable container is also vapor-impermeable. In some embodiments, as illustrated in FIG. 3, the liquid-impermeable container 300 is positioned above the storage region 310 within the refrigeration device 100. In some embodiments, a liquid-impermeable container includes: an aperture of a size, shape and position to permit the set of evaporator coils to traverse the aperture; and a liquid-impermeable seal between a surface of the aperture and a surface of the set of evaporator coils. In some embodiments, a liquid-impermeable container includes: an aperture of a size, shape and position to permit the set of evaporator coils to traverse the aperture; and a vapor-impermeable seal between a surface of the aperture and a surface of the set of evaporator coils.

In some embodiments, one or more walls substantially form a liquid-impermeable container, and the liquid-impermeable container is configured to hold phase change material internal to a refrigeration device. The liquid-impermeable container 300 illustrated is fabricated from a plurality of planar walls 320 forming a cuboid structure with solid walls and a bottom, and an aperture at the topmost surface forming an open top section. The plurality of planar walls 320 of the liquid-impermeable container 300 are sealed at their edges at approximately right angles with liquid-impermeable seals. In some embodiments, the one or more walls substantially forming a liquid-impermeable container include a plurality of layers and the condenser is positioned adjacent to a surface of at least one of the plurality of layers. In some embodiments, the one or more walls substantially forming the liquid-impermeable container include a plurality of layers wherein at least one of the one or more layers includes non-planar regions to form multiple sides of the liquid-impermeable container. In some embodiments, the one or more walls substantially forming a liquid-impermeable container include an aperture of a position, size and shape to form an access opening. For example, an access opening can be of a size, shape and position to permit a user to inspect, refresh and/or renew the interior of the liquid-impermeable container and its contents. In some embodiments, the one or more walls substantially forming a liquid-impermeable container include an aperture of a position, size and shape to reversibly mate with a door. Some embodiments include an access lid within a top surface of the liquid-impermeable container, the access lid configured for a user to access an interior of the liquid-impermeable container.

Some embodiments include a phase change material positioned within the liquid-impermeable container. For example, in the embodiment shown in FIG. 3, a phase change material can be included within the liquid-impermeable container 300 in a position 305 surrounding the set of refrigeration coils 330. A "phase-change material," as used herein, is a material with a high latent heat, which is capable of storing and releasing heat energy while changing physical phase. The selection of a phase change material for an embodiment depends on considerations including the latent heat for the material, the melting point for the material, the boiling point for the material, the volume of material required to store a predetermined amount of heat energy in an embodiment, the toxicity of the material, the cost of the material, and the flammability of the material. Depending on the embodiment, a phase-change material can be a solid, a liquid, a semi-solid or a gas during use. For example, in some embodiments a phase-change material includes water, methanol, ethanol, a sodium polyacrylate/polysaccharide material or a salt hydrate. In some embodiments, for example, a phase change material including a majority of the volume as pure water/ice is preferred due to the physical property of pure water/ice having a melting point of 0° C. In some embodiments, for example, a phase change material including a majority of the volume as salt water/salt ice is preferred as the melting point of salt ice can be calibrated to below 0° C. based on the salt molarity and content within the salt water/salt ice. In some embodiments, for example, a phase change material is configured to freeze at below −20° C. In some embodiments, for example, a phase change material is configured to freeze at a point between 1° C. and 3° C. In some embodiments, a phase change material is in a liquid form at ambient temperatures (e.g. 25° C.).

The refrigeration device 100 includes an active refrigeration unit including a set of evaporator coils 330. The set of evaporator coils 330 is positioned within an interior of the liquid-impermeable container 300. In some embodiments, a refrigeration device includes two active refrigeration units, each including its own set of evaporator coils. Both sets of evaporator coils can, for example, be positioned within a single liquid-impermeable container within the refrigeration device. Each set of evaporator coils can, for example, be positioned within two liquid-impermeable containers within a single refrigeration device, and each set of refrigeration coils can be independently controlled by a single controller attached to each of the active refrigeration units. In some embodiments, a refrigeration device includes a single active refrigeration unit including two sets of evaporator coils. Each set of evaporator coils can, for example, be positioned within two liquid-impermeable containers within a single refrigeration device, and each set of refrigeration coils can be independently controlled, such as with a reversibly controlled thermal control device, such as a valve system. In some embodiments, a refrigeration device includes an active refrigeration unit that includes an active refrigeration system. In some embodiments, a refrigeration device includes an active refrigeration unit that includes an electrically powered compression system.

In some embodiments, a refrigeration device includes an active refrigeration unit that includes a compressor. The embodiment shown in FIG. 3 includes a compressor 335 operably attached to the set of evaporator coils 330. In some embodiments, a refrigeration device includes a controller. The embodiment illustrated in FIG. 3 includes a controller 380 positioned between the compressor 335 and a wire connection 395 to an electric source. A controller can include, depending on the embodiment, an electronic controller with circuitry configured to send control signals to the compressor and/or other features of the device. A controller can include, depending on the embodiment, an electronic controller with circuitry configured to receive signals from the compressor and/or other features of the device such as sensors or monitors. In some embodiments, a controller includes a wireless signal generator, such as a cellular radio transmitter. In some embodiments, a controller includes circuitry for data acquisition, such as data from one or more sensors, and/or a power monitor. In some embodiments, a controller includes circuitry for temperature control, such as by sending a control signal to an operably attached compressor. In some embodiments, a controller includes circuitry for temperature display, such as by sending a control signal to an operably attached display unit. In some embodiments, a controller includes: circuitry for receiving data from one or more sensors; circuitry for evaluating received data for one or more predetermined set point values; circuitry to send a control signal in response to a detected value that meets one or more predetermined set point values; and circuitry to transmit the received data externally to the refrigeration device. For example, in some embodiments a controller can be configured to: receive data from multiple temperature sensors; to evaluate the received data relative to predetermined maximum and/or minimum values; to send a control signal in response to a detected maximum and/or minimum value; and to send a signal including the received data to a monitoring system.

In some embodiments, a refrigeration device is expected to be used in locations with intermittent power availability, such as due to periodic failure of a municipal power grid or unavailability of solar power. A refrigeration device can include, for example, a battery affixed to the at least one active refrigeration unit. A refrigeration device can be configured to utilize battery power to run the active refrigeration unit conditionally, for example if there is a lack of power for a predetermined period of time (e.g. 2 days, 3 days, or 4 days). A refrigeration device can be configured to utilize battery power to run the active refrigeration unit conditionally, for example if a temperature sensor positioned within the refrigeration device detects a temperature above a predetermined threshold level.

In some embodiments, a refrigeration device is expected to be used in locations with variable power availability, such as a power supply of varying voltages over time. A refrigeration device can include, for example, a variable power control system attached to the at least one active refrigeration unit. In some embodiments, a variable power control system can be designed to accept power from different sources, such as 120, 230 VAC, and 12 to 24 VDC. In some embodiments, a variable power control system can include a power converter. The power converter can, for example, be configured to convert AC input power to DC. The power converter can, for example, be configured to convert variable AC input power to 220 V AC. In some embodiments, a variable power control system includes an automatic voltage regulator. For example, a refrigeration device configured for use in a location with a poorly functioning electrical grid can be configured to accept power in the range of 90 V AC to 250 V AC and covert the input to a steady 220 V AC with an integral automatic voltage regulator. A refrigeration device can include one or more voltage and/or current sensors positioned and configured to detect the power supply to the refrigeration device. The sensors can be attached to a controller, and/or a transmitter unit, and/or a memory unit. A refrigeration device can include a voltage stabilizer. A refrigeration device can include a power conditioning unit. Some embodiments of a refrigeration device are designed to be operational with or without routine electricity from a power grid, such as a municipal power grid. For example, a refrigeration device can be configured to permit operation from a power grid when such is available, and from an alternate power source, such as a photovoltaic unit, at other times. For example, a refrigeration device can be configured to permit operation from a power grid in response to input from a user, and from an alternate power source, such as a photovoltaic unit, in response to other input, such as the availability of solar energy. Some embodiments, for example, include a photovoltaic unit configured to provide power to a battery. Some embodiments, for example, include a photovoltaic unit configured to provide power directly to a refrigeration device. Some embodiments include a photovoltaic unit with a power of 50 Watt (W) peak. Some embodiments include a photovoltaic unit with a power of 100 Watt (W) peak. Some embodiments include a photovoltaic unit with a power of 150 Watt (W) peak. Some embodiments include a photovoltaic unit with a power of 200 Watt (W) peak. Some embodiments are configured to utilize energy from different sources, depending on availability and the preferences of a user. For example, some embodiments include circuitry to accept power from a photovoltaic unit and a controller to direct the accepted power to either the active refrigeration system directly or to a battery. This selection can be directed by a user through an interface, or controlled based on predetermined criteria, such as the time of day, external temperature, or temperature information from one or more temperature sensors within the refrigeration device. Some embodiments include a controller configured to be responsive to the detected conditions of a refrigeration device. Some embodiments include circuitry configured to direct power through a power inverter with a rating in the range of 1.5 to 2.0 KW from a 12 Volt (V) battery to start and power the existing active refrigeration system of a refrigeration device. Some embodiments are configured to power a thermoelectric unit from the sealed battery under control of the controller in response to information from the temperature sensor within a storage region. For embodiments wherein the interior storage region of the temperature-controlled container is in the 15 liter (L) to 50 L range, a 50 W peak photovoltaic unit should be able to maintain a predetermined temperature range between approximately 2° C. to 8° C. continually with one hour of maximum output from the photovoltaic cell per 24 hour period. The system can also include a charge monitor, configured to ensure that the battery is not depleted below a preset threshold, for example 80% of its charge, to extend the life of the battery during use.

Some embodiments include a power monitor operably connected to the refrigeration device. Some embodiments include a power monitor positioned between an electricity source and other components of the refrigeration device. Some embodiments include a power monitor positioned after a voltage cutoff switch. Some embodiments include a power monitor positioned between a power stabilizer and the compressor. For example, the embodiment illustrated in FIG. 3 includes a power monitor 390 operably connected to the wire connection 395 to an electric source. Some embodiments include a power monitor operably attached to the controller. For example, FIG. 3 depicts an embodiment including a power monitor 390 operably connected with a wire connector to the controller 380. A power monitor can include a power sampling unit, for example a 1 kHz power sampling unit. A power monitor can include a power sampling unit, for example a 2 kHz power sampling unit. A power monitor can include a power sampling unit, for example a 3 kHz power sampling unit. A power monitor can include a power sampling unit, for example a 4 kHz power sampling unit. A power monitor can include a power sampling unit, for example a 5 kHz power sampling unit. A power monitor can include a surge protector, which can be configured to operate in an expected surge situation depending on the expected geographic region of use of a refrigeration device. A power monitor can include a high voltage cutoff switch, such as a high voltage cutoff switch configured to activate at a predetermined maximum voltage for the refrigeration device. A power monitor can include a low voltage cutoff switch, such as a low voltage cutoff switch configured to activate at a predetermined minimum voltage for the refrigeration device. A power monitor can include a voltage stabilizer. A power monitor can include a battery. For example, a power monitor can include a battery configured to provide sufficient power to monitor a power outage and the return of power.

In some embodiments, a refrigeration device includes: a first section of the set of evaporator coils positioned adjacent to an exterior surface of the one or more walls substantially forming the liquid-impermeable container; a second section of the set of evaporator coils positioned within the interior of the liquid-impermeable container; and a frame of a size and shape to enclose one or more containers for frozen phase change material, the frame in thermal contact with the first section of the set of evaporator coils. In some embodiments, a refrigeration device includes: a first set of evaporator coils positioned adjacent to an exterior surface of the one or more walls substantially forming the liquid-impermeable container; a second set of evaporator coils positioned within the interior of the liquid-impermeable container; and a frame of a size and shape to enclose one or more containers for frozen phase change material, the frame in thermal contact with the first set of evaporator coils.

In the embodiment illustrated in FIG. 3, the refrigeration device 100 includes one or more walls 340 substantially forming a storage region 310. The walls can be, for example, substantially planar and affixed at approximate right angles to each other. The storage region can form a cuboid structure, such as illustrated in FIG. 3. The storage region can include an aperture, the aperture positioned and sized to reversibly mate with a door (see, e.g. FIGS. 1 and 2). The storage region can include internal shelving, racks, and similar features. In some embodiments, the storage region is configured for medical storage, such as storage for vaccine vials and/or medicinal packages.

In some embodiments, a refrigeration device includes a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector with a hollow interior affixed to both the condenser and the evaporator, the connector forming a liquid and vapor flow path between the hollow interior of the condenser and the hollow interior of the evaporator. The liquid and vapor flow path formed by the connector permits liquid to flow downwards and vapor to flow upwards within a single connector. In some embodiments, there is a single connector forming a bidirectional liquid and vapor flow path between the hollow interior of the evaporator and the hollow interior of the condenser. In some embodiments, there are two or more connectors, each of which independently form a bidirectional liquid and vapor flow path between the hollow interior of the evaporator and the hollow interior of the condenser. In the embodiment illustrated in FIG. 3, the refrigeration device includes a heat transfer system including a first group of vapor-impermeable structures connected to form a condenser 350 in thermal contact with the one or more walls 320 substantially forming a liquid-impermeable container 300. FIG. 3 also illustrates a refrigeration device including a heat transfer system including a second group of vapor-impermeable structures connected to form an evaporator 360 in thermal contact with the one or more walls 340 substantially forming a storage region 310. The embodiment shown in FIG. 3 includes a connector 370 with a hollow interior affixed to both the condenser 350 and the evaporator 360, the connector 370 forming a liquid and vapor flow path between the hollow interior of the condenser 350 and the hollow interior of the evaporator 360. In some embodiments, the heat transfer system includes a contiguous substantially sealed hollow interior, and an evaporative liquid sealed within the contiguous substantially sealed hollow interior. As illustrated in FIG. 3, in some embodiments the connector is a substantially linear structure positioned to be substantially vertical when the refrigeration device is in a position for use.

In some embodiments, the evaporator and/or the condenser of the heat transfer system are connected to multiple walls of the liquid-impermeable container and the storage region. See, e.g. FIG. 7. In some embodiments, the first group of vapor-impermeable structures connected to form a condenser are contiguous and in thermal contact with two or more walls of the liquid-impermeable container. For example, the condenser can be fabricated from multiple hollow tubes fused together and positioned in thermal contact with two or more walls of the liquid-impermeable container. For example, the condenser can be fabricated from a single roll-bond fabricated structure that is bent and positioned to form multiple walls of the liquid-impermeable container. In some embodiments, the second group of vapor-impermeable structures connected to form an evaporator are contiguous and in thermal contact with two or more walls of the storage region. For example, the evaporator can be fabricated from multiple hollow tubes fused together and positioned in thermal contact with two or more walls of the storage region. For example, the evaporator can be fabricated from a single roll-bond fabricated structure that is bent and positioned to form multiple walls of the storage region In some embodiments, the heat transfer system forms a unidirectional thermal conductor within the refrigeration device. A "unidirectional thermal conductor," as used herein, refers to a structure configured to permit thermal transfer in one direction along its long axis, while substantially inhibiting thermal transfer in the reverse direction along the same long axis. A unidirectional thermal conductor is designed and implemented to encourage the transmission of thermal energy (e.g. heat) in one direction along the length of the unidirectional thermal conductor, while substantially suppressing the transmission in the reverse direction along the length of the unidirectional thermal conductor. In some embodiments, for example, a unidirectional thermal conductor includes a linear heat pipe device. In some embodiments, for example, a unidirectional thermal conductor includes a thermosyphon. In some embodiments, for example, a unidirectional thermal conductor includes a thermal diode device. For example, a unidirectional thermal conductor can include a hollow tube fabricated from a thermally conductive material, the hollow tube sealed at each end and including an evaporative liquid in both a volatile liquid form and in a gas form. For example, a unidirectional thermal conductor can include a tubular structure with a substantially sealed internal region, and an evaporative fluid sealed within the substantially sealed internal region. In some embodiments, for example, a unidirectional thermal conductor is configured as a ½ inch diameter copper pipe. In some embodiments, a unidirectional thermal conductor can be wholly or partially fabricated with a roll-bond technique. In some embodiments, a unidirectional thermal conductor can include an internal geometry positioned and configured to distribute evaporative liquid along the interior surface of the unidirectional thermal conductor. For example, a unidirectional thermal conductor can include an internal surface with grooves, channels, or similar structures of a size, shape and position to distribute evaporative liquid along the internal surface. In some embodiments, a unidirectional thermal conductor can include an interior wick structure throughout the interior or at specific regions of the interior. In some embodiments, a unidirectional thermal conductor can include an interior sintered structure throughout the interior or at specific regions of the interior.

In some embodiments, a unidirectional thermal conductor can include multiple hollow branches, each in vapor connection with each other, each including an evaporative liquid in both a volatile liquid form and in a gas form. Some embodiments include multiple unidirectional thermal conductors. For example, some embodiments include multiple unidirectional thermal conductors arranged in parallel along a single axis. For example, some embodiments include multiple unidirectional thermal conductors utilized in different regions of the refrigeration device, the multiple unidirectional thermal conductors acting independently of each other. Some embodiments include multiple unidirectional thermal conductors including the same evaporative liquid. Some embodiments include multiple unidirectional thermal conductors including different evaporative liquids, for example positioned in different regions of a refrigeration device.

A unidirectional thermal conductor is configured so that the liquid and gas form of the evaporative liquid will be in thermal equilibrium. A unidirectional thermal conductor is substantially evacuated during fabrication, then sealed with a gas-impermeable seal, so that substantially all of the gas present within the unidirectional thermal conductor is the gas form of the liquid present. The vapor pressure within a unidirectional thermal conductor is substantially entirely the vapor pressure of the liquid, so that the total vapor pressure is substantially equivalent to the partial pressure of the liquid. A unidirectional thermal conductor includes an internal flow path for both an evaporative liquid and its vapor. In some embodiments, the unidirectional thermal conductor includes an internal flow path sufficient for two phase flow of the evaporative liquid within the interior of the unidirectional thermal conductor. For example, a connector can include a bidirectional internal flow path. For example, a connector can include both a liquid and a vapor flow path. In some embodiments, a unidirectional thermal conductor can be configured to operate in a substantially vertical position, with thermal transfer from the lower end to the upper end carried out through vapor rising within the unidirectional thermal conductor and condensing at the upper end. In some embodiments, the unidirectional thermal conductor includes an evaporative liquid wherein the expected surface level of the evaporative liquid is within a storage region of a temperature-controlled container when the unidirectional thermal conductor is in its expected position within the container.

In some embodiments, for example, a unidirectional thermal conductor includes an evaporative liquid that includes one or more alcohols. In some embodiments, for example, a unidirectional thermal conductor includes an evaporative liquid that includes one or more liquids commonly used as refrigerants. In some embodiments, for example, a unidirectional thermal conductor includes water. In some embodiments, for example, a unidirectional thermal conductor includes an evaporative liquid that includes: R-134A refrigerant, iso-butane, methanol, ammonia, acetone, water, isobutene, pentane, or R-404 refrigerant.

Some embodiments include a unidirectional thermal conductor that includes an elongated structure. For example, a unidirectional thermal conductor can include a substantially tubular structure. A unidirectional thermal conductor can be configured as a substantially linear structure. A unidirectional thermal conductor can be configured as a substantially non-linear structure. For example, unidirectional thermal conductor can be configured as a non-linear tubular structure. In some embodiments, one or more thermal conduction units are attached to an exterior surface of a unidirectional thermal conductor. For example, one or more planar structures, such as fin-like structures, fabricated from a thermally-conductive material can be attached to the exterior surface of a unidirectional thermal conductor and positioned to promote thermal transfer between the unidirectional thermal conductor and an adjacent region. A unidirectional thermal conductor can be fabricated from a thermally-conductive metal. For example, a unidirectional thermal conductor can include copper, aluminum, silver or gold.

In some embodiments, a unidirectional thermal conductor can include a substantially elongated structure. For example, a unidirectional thermal conductor can include a substantially tubular structure. The substantially elongated structure includes an evaporative liquid sealed within the structure with gas-impermeable seals. For example, a unidirectional thermal conductor can include welded or crimped gas-impermeable seals. In some embodiments, the evaporative liquid includes one or more of: water, ethanol, methanol, or butane. The selection of the evaporative liquid in an embodiment depends on factors including the evaporation temperature of the evaporative liquid in the particular unidirectional thermal conductor structure in the embodiment, including the gas pressure within the unidirectional thermal conductor. The interior of the structure of the unidirectional thermal conductor includes a gas pressure below the vapor pressure of the evaporative liquid included in that embodiment. When the unidirectional thermal conductor is positioned within a temperature-controlled container in a substantially vertical position, the evaporative liquid evaporates from the lower portion of the unidirectional thermal conductor, wherein the resulting vapor rises to the upper portion of the unidirectional thermal conductor and condenses, thus transferring thermal energy from the lower portion of the unidirectional thermal conductor to the upper portion. In some embodiments, a unidirectional thermal conductor includes a structure including an adiabatic region positioned between the condensing end and the evaporative end, the adiabatic region positioned between the liquid-impermeable container and the storage region of the refrigeration device.

Some embodiments include a unidirectional thermal conductor that is affixed to a thermally-conductive coupling block and a heat pipe. The coupling block and heat pipe can, for example, be positioned and configured to moderate the thermal transfer along the length of the unidirectional thermal conductor.

In some embodiments, the first group of vapor-impermeable structures with the hollow interior connected to form the condenser form a branched structure. For example, FIG. 3 illustrates a branching, zig-zag pattern of structures connected to form the condenser 350. A zig-zag pattern can, for example, be positioned and configured to distribute an interior fluid evenly to create an active heat transfer region. In some embodiments, the first group of vapor-impermeable structures with the hollow interior connected to form the condenser form a branched structure wherein each end of a branch of the branched structure is the topmost region of that branch. In some embodiments, the first group of vapor-impermeable structures with the hollow interior connected to form the condenser form a branched structure wherein the branches connect at the top of the branching structure. In some embodiments, at least one wall of substantially forming the liquid-impermeable container is fabricated from one or more roll bonded plates. For example, one or more roll-bonded plates can be fabricated to include a first group of vapor-impermeable structures with a hollow interior that are connected to form the condenser of the refrigeration device, and the one or more roll bonded plates can be integrated into the one or more walls substantially forming the liquid-impermeable container. In some embodiments, the first group of vapor-impermeable structures with the hollow interior connected to form the condenser are integral to at least one of the one or more walls of the liquid-impermeable container. For example, the first group of vapor-impermeable structures can be part of a roll-bond structure forming one or more walls of the liquid-impermeable container. In some embodiments, the first group of vapor-impermeable structures with the hollow interior connected to form the condenser are in direct thermal contact with at least one of the one or more walls of the liquid-impermeable container.

In some embodiments, the second group of vapor-impermeable structures with the hollow interior connected to form the evaporator form a branched structure. FIG. 3, for example, illustrates a branching, zig-zag pattern of structures connected to form the evaporator 360. A zig-zag pattern can, for example, be positioned and configured to distribute an interior fluid evenly to create an active heat transfer region. In some embodiments, the second group of vapor-impermeable structures with the hollow interior connected to form the evaporator form a branched structure wherein each end of a branch of the branched structure is the lowest region of that branch. In some embodiments, the second group of vapor-impermeable structures with the hollow interior connected to form the evaporator form a branched structure wherein the branches connect at the bottom of the branching structure. In some embodiments, at least one wall substantially forming the storage region is fabricated from one or more roll bonded plates. For example, one or more roll-bonded plates can be fabricated to include a second group of vapor-impermeable structures with a hollow interior that are connected to form the evaporator of the refrigeration device, and the one or more roll bonded plates can be integrated into the one or more walls substantially forming the storage region. Roll-bond plates can be fabricated as one unit which is then bent or flexed to form walls of a storage region and/or a liquid-impermeable container. In some embodiments, the second group of vapor-impermeable structures with the hollow interior connected to form the evaporator are integral to at least one of the one or more walls of the storage region. In some embodiments, the second group of vapor-impermeable structures with the hollow interior connected to form the evaporator are in direct thermal contact with at least one of the one or more walls of the storage region. For example, the second group of vapor-impermeable structures can be part of a roll-bond structure forming one or more walls of the storage region.

Figure 4:
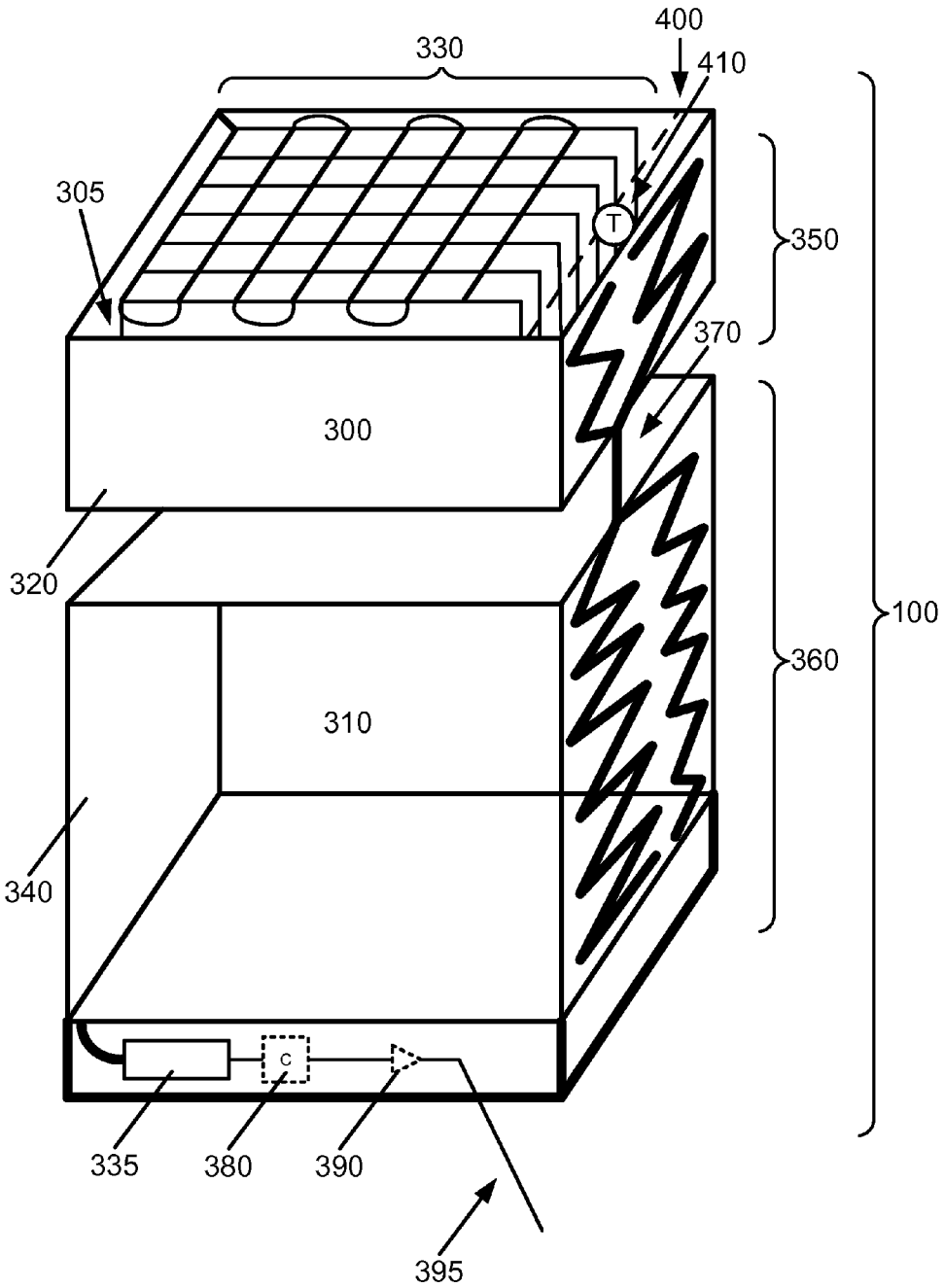
FIG. 4 is a schematic of a refrigeration device.

FIG. 4 depicts an embodiment of a refrigeration device 100 including a sensor 410 positioned within the liquid-impermeable container 300 at a location between an interior surface of the container walls 320 and the set of evaporator coils 330. The sensor can, for example, be a temperature sensor, such as an electronic temperature sensor. Some embodiments include: at least one sensor positioned within the liquid-impermeable container between the one or more walls and the set of evaporator coils; and a controller operably attached to the at least one active refrigeration unit and to the sensor. A sensor can be operably connected to a controller with a wireless connection. A sensor can be operably connected to a controller with a wire connector. In some embodiments, a sensor is configured to send signals including sensed data to the controller at fixed time intervals, such as every hour, every 2 hours, or every 3 hours. In some embodiments, a sensor is configured to send signals including sensed data to the controller at fixed time intervals, such as every minute, every 2 minutes, or every 3 minutes. In some embodiments, a sensor is configured to send signals including sensed data to the controller at fixed time intervals, such as every second, every 2 seconds, or every 3 seconds. In some embodiments, a sensor is configured to send signals including sensed data to the controller when the sensed parameter is outside of a particular preset range of values. For example, in some embodiments a temperature sensor is configured to send a signal to an attached controller in response to the temperature sensor detecting a temperature outside of a predetermined range of values, for example above 3 degrees C. or below 0 degrees C.

In some embodiments, a controller includes circuitry for turning an active refrigeration unit on and off in response to data received from the sensor. For example, in the embodiment shown in FIG. 4, the refrigeration device is calibrated to work efficiently when the set of evaporator coils 330 is positioned within the liquid-impermeable container 300 and a phase change material is located at a position 305 around the set of evaporator coils 330. When the active refrigeration unit is operating, the compressor 335 acts to cool the set of refrigeration coils 330, which consequently cools the phase change material located at a position 305 around the set of evaporator coils 330. The refrigeration device 100 can be calibrated, for example, to operate efficiently when the phase change material is cool enough to freeze up to a location within the liquid-impermeable container 300, for example a freeze line 400. The temperature sensor 410 is positioned between the intended freeze line 400 and a wall 320 of the liquid-impermeable container 300 in direct contact with the condenser 350.

Some embodiments include a heat transfer system that is calibrated to maintain an internal temperature of the storage region within a predetermined temperature range when a phase change material positioned within the liquid-impermeable container is maintained within a predetermined temperature range. For example, a refrigeration device can include sufficient insulation wherein at an expected ambient temperature range the heat transfer system will remove heat from the storage region at a rate equivalent to the heat leak from the storage region, and therefore to passively maintain the internal temperature of the storage region within a preset temperature range. Factors included in the calibration of a heat transfer system include the physical properties, such as thermal conductive properties, of the materials that are fabricated into the heat transfer system, the evaporative liquid within the heat transfer system, the position and configuration of the heat transfer system relative to the storage region and the liquid-impermeable container, and the phase change material utilized within the liquid-impermeable container.

Some embodiments include: at least one sensor positioned within the liquid-impermeable container between the one or more walls and the set of evaporator coils; and a controller operably attached to the at least one active refrigeration unit and to the sensor. Some embodiments include: at least one sensor positioned adjacent to an interior wall of the storage region; and a controller operably attached to the at least one active refrigeration unit and to the sensor. Some embodiments include: at least one sensor positioned adjacent to the evaporator of the heat transfer system; and a controller operably attached to the at least one active refrigeration unit and to the sensor. Some embodiments further include circuitry for turning the at least one active refrigeration unit on and off in response to data received from the sensor. For example, a temperature sensor can be positioned within the liquid-impermeable container, and operably connected to a controller configured to receive signals from the temperature sensor and to send control signals, such as on/off control signals, to the at least one active refrigeration unit in response to the received signals from the temperature sensor. In an embodiment, a liquid-impermeable container can be configured to include water as a phase change material, and a temperature sensor positioned and calibrated to detect if the water is freezing or near freezing (e.g. in a temperature range between 2 degrees C. and −1 degrees C.). A controller attached to the temperature sensor can include circuitry configured to send a "off" control signal to an active refrigeration unit when the received data indicates a freezing temperature, for example 0 degrees C. or below. The controller can further include circuitry configured to send an "on" control signal to an active refrigeration unit when the received data indicates a sufficiently warm temperature, for example 2 degrees C. or higher.

Some embodiments include a heat transfer system that permits variable thermal flow from the storage region to the liquid-impermeable container. Some embodiments include a heat transfer system with at least one thermal control device connected to the connector, the thermal control device positioned and configured to reversibly control size of the hollow interior of the connector. By reversibly controlling the size of the hollow interior of the connector, the volume of liquid and vapor flow of the evaporative liquid within the heat transfer system can be altered, and consequently the thermal flow.

A "thermal control device," as used herein, is a device positioned and configured to regulate the flow of evaporative liquid, in either liquid or vapor state, through a heat transfer system between the evaporative end and the condensing end. A thermal control device changes configuration in response to a stimulus, and thereby alters thermal transfer along the entirety of the attached heat transfer system. In some embodiments, a thermal control device operates in a binary state, either opening or closing the flow pathway within the heat transfer system. In some embodiments, a thermal control device operates in an analog manner, with multiple possible states opening and closing the flow pathway within the heat transfer system to varying levels. For example, a thermal control device can include a valve with multiple partially restricted configurations. For example, a thermal control device can include a valve that can be stably set to positions including 20% restricted flow through the valve, 30% restricted flow through the valve, 40% restricted flow through the valve, 50% restricted flow through the valve, 60% restricted flow through the valve, 70% restricted flow through the valve, and 80% restricted flow through the valve. For example, a thermal control device can include a valve that is a solenoid valve. A thermal control device, through control of evaporative liquid flow, can increase or decrease the thermal energy transferred through a heat transfer system. A thermal control device can, for example, be configured to regulate the flow of evaporative liquid, in either liquid or vapor state, through a heat transfer system in response to a temperature. In some embodiments, a thermal control device is a passive device. For example a passive thermal control device can include a bimetallic element configured to change position in response to a change in temperature within the heat transfer system. In some embodiments, a thermal control device is an active device, such as requiring power to operate and under the active control of a controller. For example, a thermal control device can include an electrically-operable valve internal to the heat transfer system, such as within the connector, the valve attached to a controller and a power source external to the heat transfer system. For example, in some embodiments a thermal control device includes a valve, such as a globe valve, a motor operably connected to the valve and a battery operably connected to the motor. In some embodiments, a thermal control device is entirely internal to the regulated heat transfer system. In some embodiments, a thermal control device is partially internal to the regulated heat transfer system and partially external to it, for example including one or more power couplings or control features.

Figure 5:
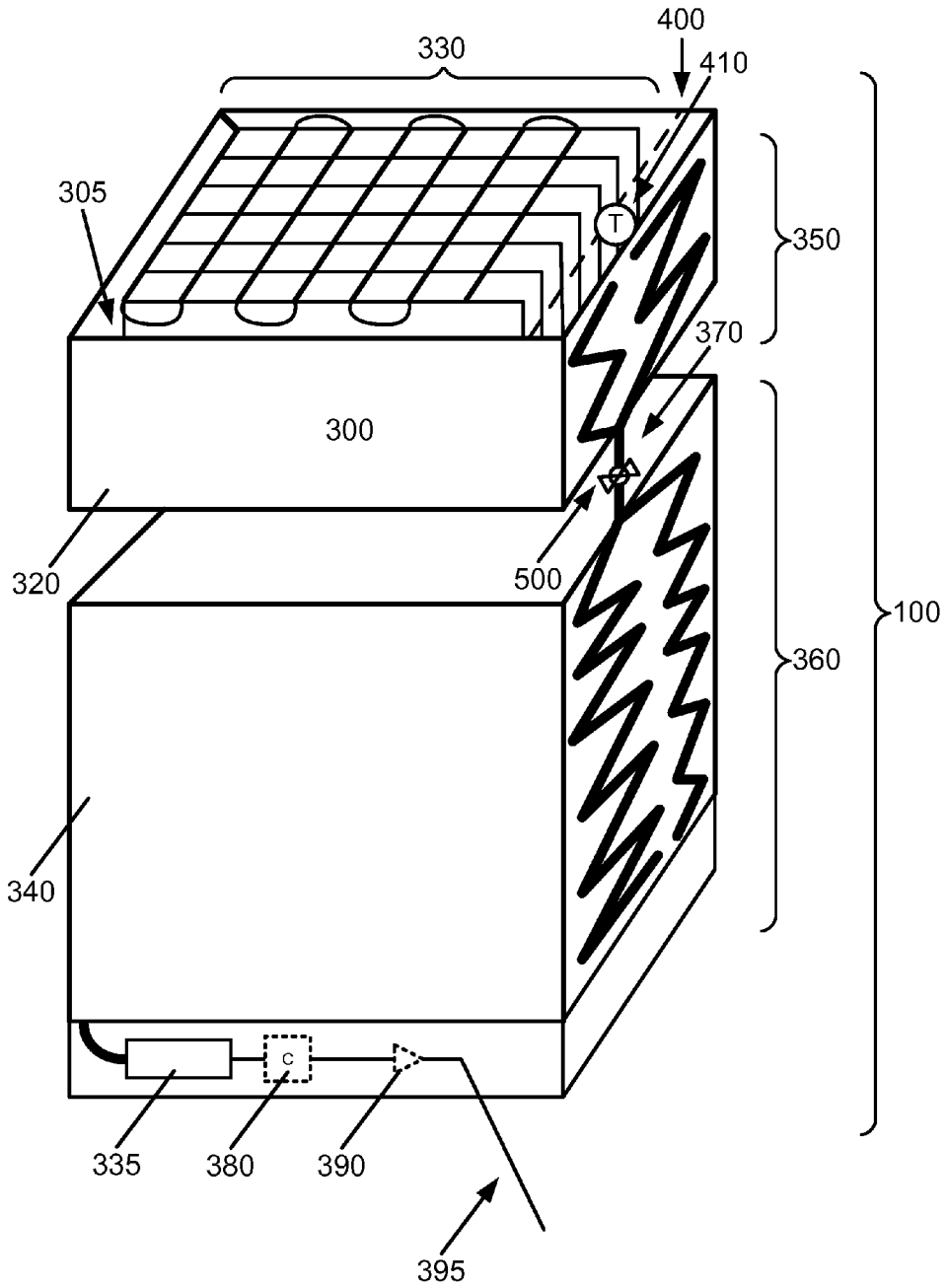
FIG. 5 is a schematic of a refrigeration device.

For example, FIG. 5 depicts an embodiment including a thermal control device 500 affixed to the connector 370 of a heat transfer system. In the embodiment illustrated, the thermal control device 500 includes a valve positioned and affixed in a manner to reversibly control vapor and fluid flow within the connector 370, thereby regulating the thermal dynamics of the heat transfer system. In some embodiments, the valve is operably connected to the controller, and the controller includes circuitry configured to send control signals to the valve. For example, the valve can be operably connected to the controller with a wireless connection. For example, the valve can be operably connected to the controller with a wire connector. For example, the controller can include circuitry configured to send control signals to the valve in response to data received by the controller from a sensor positioned within the liquid-impermeable container. For example, the controller can include circuitry configured to send control signals to the valve in coordination with control signals sent by the controller to the compressor. In some embodiments, a thermal control device is a passive device, and is not operably connected to the controller. For example, a thermal control device can include a mechanism calibrated to open and close a valve affixed to a connector in response to the temperature of the connector.

Some embodiments include a heating element positioned adjacent to the condenser of the heat transfer system, wherein the heating element is configured to reversibly and controllably provide heat to the condenser to prevent cooling of the condenser below a predetermined minimum temperature. For example, a heating element could in some embodiments include an electric heating element, the heating element operably connected to a controller and configured to be responsive to control signals sent from the controller. The controller can be configured to receive signals from a temperature sensor, and to send control signals to the heating element in response to the data of the temperature sensor. For example, an embodiment can include a temperature sensor positioned adjacent to an evaporator, wherein the temperature sensor sends data to a controller and the controller sends control signals to the heating element in response to the data received from the temperature sensor. In some embodiments, a controller can be configured to receive data from an active refrigeration unit, and to send control signals to a heating element positioned adjacent to a condenser of a heat transfer system in response to received data from the active refrigeration unit. For example, a controller can be configured to turn on a heating element after an active refrigeration unit has been operating for a length of time, such as 6 hours, 8 hours, 12 hours, or 24 hours.

In some embodiments, a refrigeration device includes a second storage region, the second storage region positioned and configured to maintain its interior within a second temperature range. For example, a second temperature range can be below freezing (e.g. less than 0 degrees C.). In some embodiments, a second temperature range can be between −5 degrees C. and −15 degrees C. In some embodiments, a second temperature range can be between −15 degrees C. and −25 degrees C. A refrigeration device can be configured, for example, with a second door positioned for a user to access the second storage region (e.g., see FIG. 2). Some embodiments of a refrigeration device further include: a frame affixed to an exterior surface of the one or more walls substantially forming the liquid-impermeable container at a position distal to the condenser, the frame of a size and shape to enclose one or more containers for frozen phase change material; and at least one tensioner within the frame, the tensioner oriented to press the one or more containers against the one or more walls. In some embodiments, the frame includes at least one positioning element, the positioning element oriented to assist in positioning the one or more containers for frozen phase change material adjacent to the exterior surface of the one or more walls. Some embodiments include wherein the set of evaporator coils include an exterior section positioned adjacent to a frame on the exterior of the liquid-impermeable container, and an interior section positioned within the interior of the liquid-impermeable container. Some embodiments include two or more sets of evaporator coils independently attached to a compressor, wherein a first set of evaporator coils are positioned within the interior of the liquid-impermeable container, and a second set of evaporator coils are positioned adjacent to the exterior of the liquid-impermeable container.

Figure 6:
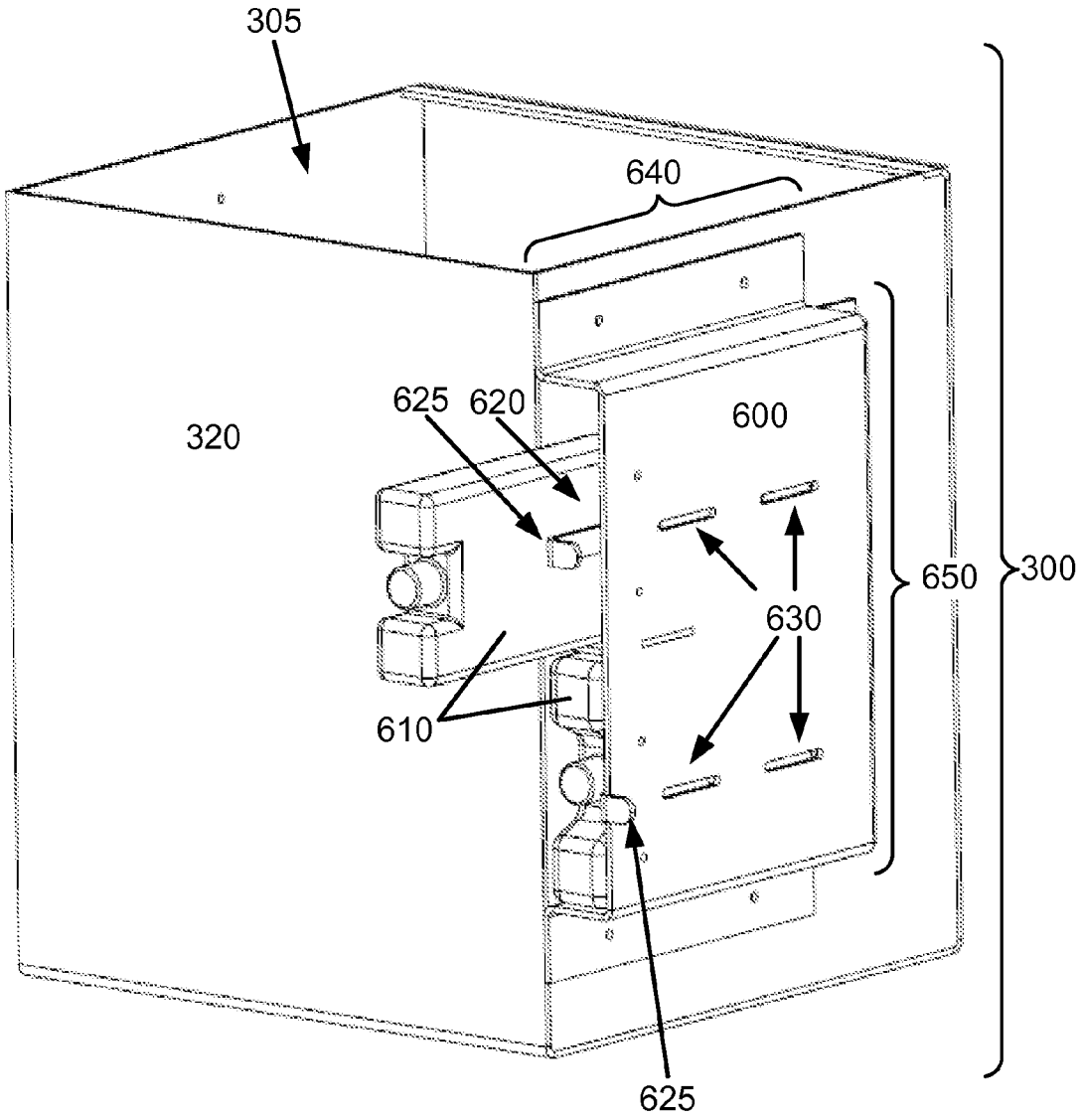
FIG. 6 is a schematic of a region of a refrigeration device.

For example, FIG. 6 depicts an embodiment wherein a frame 600 is affixed to an exterior surface of a wall 320 of the liquid-impermeable container 300. The liquid-impermeable container includes an interior position 305 that would include phase-change material surrounding a set of evaporator coils when the embodiment is in use; for illustration purposes the set of evaporator coils is not shown in FIG. 6. The frame is positioned and oriented to hold containers 610 for frozen phase change material adjacent to a section 640 of the exterior surface of a wall 320 of the liquid-impermeable container 300. For example, a container for holding frozen phase change material can include, in some embodiments, a WHO-standard ice pack for medical outreach. The embodiment of the frame 600 shown in FIG. 6 includes a substantially planar exterior section 650 which is oriented to position the containers 610 for frozen phase change material adjacent to the section 640 of the exterior surface of the wall 320. A positioning element 620 including two substantially planar opposing surfaces is located between the interior face of the substantially planar exterior section 650 of the frame and a substantially planar outer wall of a container 610 for frozen phase change material. In the embodiment shown in FIG. 6, the frame 600 includes two distinct positioning elements 620. Each of the positioning elements includes a tab 625 at one end, the tab 625 of a size and shape to assist a user to reversibly slide the positioning element relative to the frame 600, thereby assisting in the removal of the adjacent container 610. The substantially planar exterior section 650 of the frame 600 can include guides 630, the guides of a size and shape to position one or more tabs of each positioning element 620, thereby maintaining the relative orientation of the positioning element 620 to the frame 600. Some embodiments include one or more tension elements within a frame, the tension elements oriented and configured to hold one or more containers for frozen phase change material in direct contact with the exterior surface of the wall of a liquid-impermeable container. For example, a frame can include an interior torsional spring. For example, a frame can include a semi-elliptical spring positioned and oriented to hold a container.

Some embodiments include a frame affixed to an exterior surface of the one or more walls substantially forming the liquid-impermeable container at a position distal to the condenser, the frame of a size and shape to enclose one or more containers for frozen phase change material, wherein the frame is positioned within a second liquid-impermeable container. The frame can be positioned and configured to maintain a position of one or more containers for frozen phase change material in thermal contact with the second liquid-impermeable container. The second liquid-impermeable container can be configured to contain a material with thermal characteristics sufficient to freeze and maintain the frozen state of one or more containers for frozen phase change material which are in thermal contact with the second liquid-impermeable container. The second liquid-impermeable container can be configured to contain a phase change material. In some embodiments, the second liquid-impermeable container can be configured to contain a second phase change material with a lower freezing temperature than the first phase change material. In some embodiments, the second liquid-impermeable container can be configured to contain a second phase change material with a higher melting point than the first phase change material. For example in an embodiment wherein the first liquid-impermeable container includes water as a phase change material, the second liquid-impermeable container includes salt water, which has a freezing temperature below (non-salt) water. For example in an embodiment wherein the first liquid-impermeable container includes water as a phase change material, the second liquid-impermeable container includes a phase change material with a freezing temperature of −10 degrees C. For example in an embodiment wherein the first liquid-impermeable container includes water as a phase change material, the second liquid-impermeable container includes a phase change material with a freezing temperature of −20 degrees C.

Some embodiments of a refrigeration device include: one or more walls substantially forming a liquid-impermeable container, the container configured to hold phase change material internal to a refrigeration device, wherein the one or more walls integrally include a first group of vapor-impermeable structures with a hollow interior connected to form a condenser; at least one active refrigeration unit including a set of evaporator coils, the evaporator coils positioned within an interior of the liquid-impermeable container; one or more walls substantially forming a storage region and integrally including a second group of vapor-impermeable structures with a hollow interior connected to form a evaporator; and a connector affixed to both the condenser and the evaporator, the connector forming a liquid and vapor flow path between the hollow interior of the condenser and the hollow interior of the evaporator, wherein the condenser, the evaporator and the connector form a heat transfer system integral to the refrigeration device.

Some embodiments include wherein the connector is of a size and shape to permit both liquid and vapor flow between the interior of the evaporator and the interior of the condenser of the heat transfer system. For example, FIG. 5 depicts a connector 370 positioned between the evaporator 360 and the condenser 350 of a heat transfer system integral to the refrigeration device 100. In the embodiment illustrated in FIG. 5, the heat transfer system operates with fluid and vapor flow along a linear, substantially vertical (i.e. up and down in the view of FIG. 5) pathway with bilateral movement within each of the hollow interiors of the heat transfer system.

Figure 7:
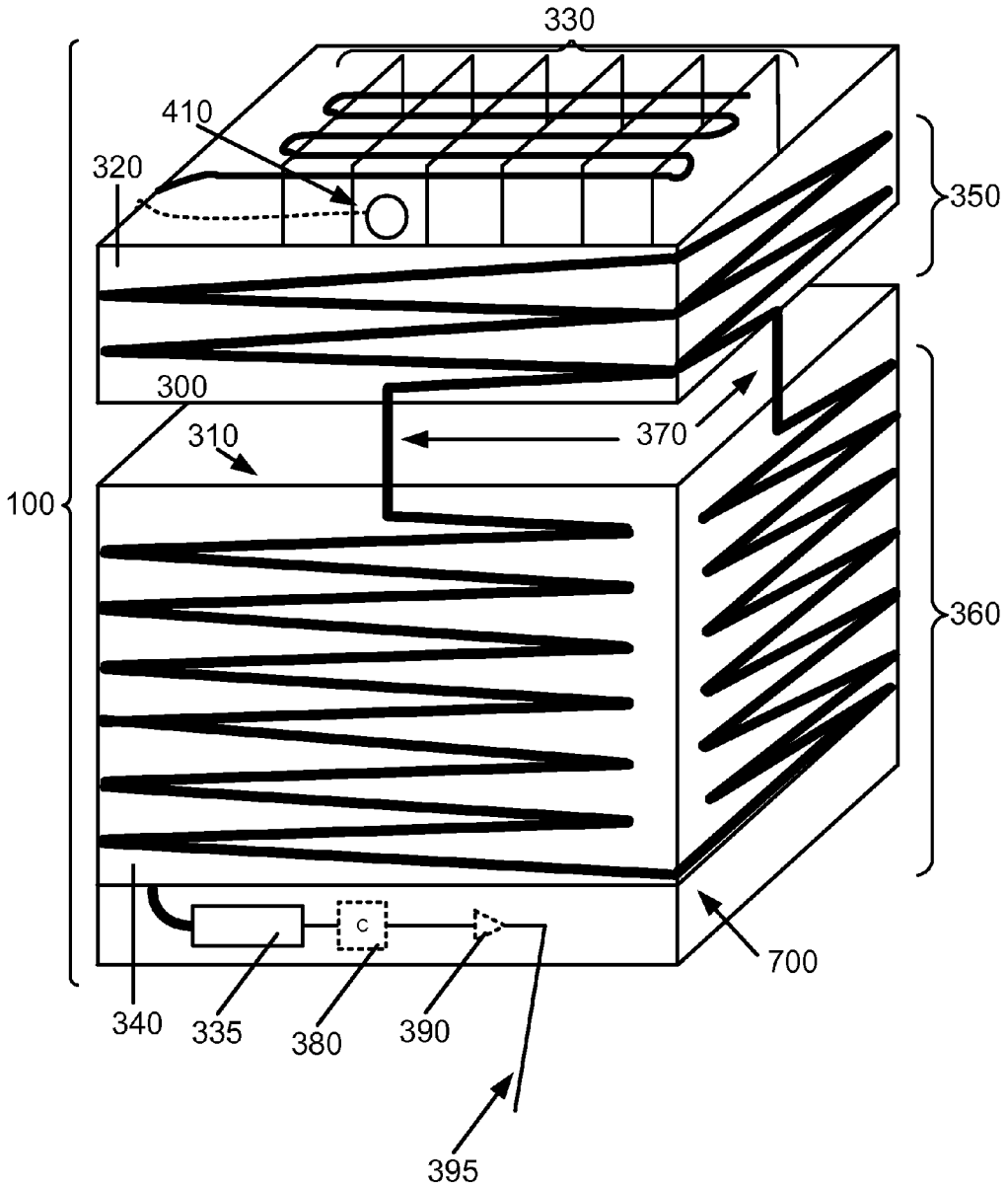
FIG. 7 is a schematic of a refrigeration device.

FIG. 7 depicts an embodiment of a refrigeration device 100. In the embodiment illustrated, a liquid-impermeable container 300 is fabricated with walls 320. Two of the walls 320 of the liquid-impermeable container 300 are in thermal contact with a condenser 350 of a heat transfer system. For example, the walls can be fabricated from a roll-bond layered material including the condenser, which is bent and positioned to form the walls of the liquid-impermeable container. A set of evaporator coils 330 is positioned within the liquid-impermeable container 300, and a sensor 410 is positioned between an edge of the set of evaporator coils 330 and the interior of a wall 320 of the liquid-impermeable container 300 that is in direct thermal contact with part of the condenser 350. The set of evaporator coils 330 are operably attached to a compressor 335, which can be further attached to a controller 380 and a power monitor 390. The refrigeration device 100 includes a power connector 395 to a power source, such as an electrical grid system. The embodiment of a condenser 350 shown in FIG. 7 is fabricated to include multiple internal loops in the liquid and vapor flow pathway within the condenser 350. The refrigeration device 100 shown in FIG. 7 includes two connectors 370 within the heat transfer system. Each of the connectors 370 provides a bidirectional liquid and vapor flow pathway to evaporative liquid within the hollow interior of the heat transfer system.

The refrigeration device 100 illustrated in FIG. 7 also includes a storage region 310 which is substantially defined by walls 340. Two of the walls 340 of the storage region 310 are in thermal contact with an evaporator 360 of the heat transfer system. For example, the walls can be fabricated from a roll-bond layered material including the evaporator, which is bent and positioned to form the walls of the storage region. In the embodiment shown in FIG. 7, the evaporator 360 includes two distinct pathways, one integrated into each side of the evaporator 360. The two distinct pathways are each configured to provide a bidirectional liquid and vapor flow pathway within the hollow interior. The two pathways within the interior of the evaporator 360 are connected at their lowest point 700.

In some embodiments, a refrigeration device includes a heat transfer system including an evaporator, a condenser, and one or more connectors, wherein each connector forms a dual vapor and liquid flow channel between an interior of the evaporator and an interior of the condenser. In some embodiments, a refrigeration device includes a heat transfer system including an evaporator, a condenser, and one connector. In some embodiments, a refrigeration device includes a heat transfer system including an evaporator, a condenser, and two connectors. For example, the two connectors can be positioned adjacent to two different faces of the refrigeration device. For example, the two connectors can be positioned adjacent to a single face of the refrigeration device. In some embodiments, a refrigeration device includes a heat transfer system including an evaporator, a condenser, and three connectors. For example, the three connectors can be positioned adjacent to three different faces of the refrigeration device, such as two side faces and a back face. For example, the three connectors can be positioned adjacent to a single face of the refrigeration device.

Some embodiments include a first group of vapor-impermeable structures with a hollow interior connected to form a condenser. The vapor-impermeable structures are also liquid-impermeable. The vapor-impermeable structures can be fabricated, depending on the embodiment, from tubes, tubular structures, regions of roll-bonded material or other materials. Some embodiments include a condenser formed from a first group of vapor-impermeable structures wherein the vapor-impermeable structures have multiple sections, and each section is connected at a low position to the connector. Some embodiments includes a condenser formed from a first group of vapor-impermeable structures wherein the vapor-impermeable structures have multiple sections, and each section is connected at a low position to the connector and at an upper position to at least one other section. Some embodiments includes a condenser formed from a first group of vapor-impermeable structures wherein the vapor-impermeable structures have multiple sections, and each section is connected at a low position to the connector and at least one intermediate position level. For example, in some embodiments the first group of vapor-impermeable structures forms a zig-zag pattern and the structures are connected to each other at intersecting points of the pattern.

Some embodiments include a second group of vapor-impermeable structures with a hollow interior connected to form an evaporator. The vapor-impermeable structures are also liquid-impermeable. The vapor-impermeable structures can be fabricated, depending on the embodiment, from tubes, tubular structures, regions of roll-bonded material or other materials. Some embodiments include an evaporator formed from a second group of vapor-impermeable structures wherein the vapor-impermeable structures have multiple sections, and each section is connected at an upper position to the connector. Some embodiments include an evaporator formed from a second group of vapor-impermeable structures wherein the vapor-impermeable structures have multiple sections, and each section is connected at an upper position to the connector and at an lower position to at least one other section. Some embodiments include an evaporator formed from a second group of vapor-impermeable structures wherein the vapor-impermeable structures have multiple sections, and each section is connected at an upper position to the connector and at least one intermediate position level. For example, in some embodiments the second group of vapor-impermeable structures forms a zig-zag pattern and the structures are connected to each other at intersecting points of the pattern.

In some embodiments, the heat transfer system is fabricated from a contiguous roll-bond material, wherein the roll bond material includes the evaporator, the condenser and the one or more connectors. For example, a roll bond material can be fabricated with the desired interior channels forming an evaporator, a condenser and one or more channels between the evaporator and the condenser, wherein the initially substantially flat roll bond material at the time of manufacture is bent to form walls of the storage region and/or the liquid-impermeable container. For example, a roll bond material fabricated to include the evaporator, the condenser and the one or more connectors and substantially flat at the time of manufacture can be reconfigured to form the sides of the storage region and/or the liquid-impermeable container after manufacture, and the reconfigured form can be integrated into a refrigeration device during assembly of the refrigeration device. In some embodiments, a refrigeration device includes: one or more walls substantially forming a liquid-impermeable container, the container configured to hold phase change material internal to a refrigeration device; at least one active refrigeration unit including a set of evaporator coils, the evaporator coils positioned within an interior of the liquid-impermeable container; a sensor positioned within the liquid-impermeable container between the one or more walls and the set of evaporator coils; one or more walls substantially forming a storage region; a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector affixed to both the condenser and the evaporator, the connector forming a liquid and vapor flow path between the hollow interior of the condenser and the hollow interior of the evaporator; and a controller operably attached to the at least one active refrigeration unit and to the sensor.

In some embodiments, a refrigeration device also includes: a thermally-conductive wall integral to the liquid-impermeable container, the thermally-conductive wall including a region projecting beyond an edge of the liquid-impermeable container; an enclosure affixed to the region of the thermally-conductive wall projecting beyond an edge of the liquid-impermeable container of the thermally-conductive wall, the enclosure including an insulating layer adjacent to the region of the thermally-conductive wall; and a frame affixed within the enclosure, the frame of a size and shape to enclose one or more containers for frozen phase change material. During use, when heat passes through the sides of the refrigeration device, the heat is dispersed along the thermally-conductive wall, including to the liquid-impermeable container. This heat dispersion assists in maintaining the interior storage region of the enclosure within a predetermined temperature range for freezing one or more containers of phase change material. For example, a thermally conductive wall can include a thermally-conductive metal, such as copper or aluminum. For example, an insulating layer can include a standard insulation material as used in refrigeration devices, such as foam insulation or one or more vacuum insulated panels. A frame of a size and shape to enclose one or more containers for frozen phase change material wherein the frame is affixed within an enclosure can include frame elements such as one or more positioning elements and/or one or more tension elements.

Figure 8:
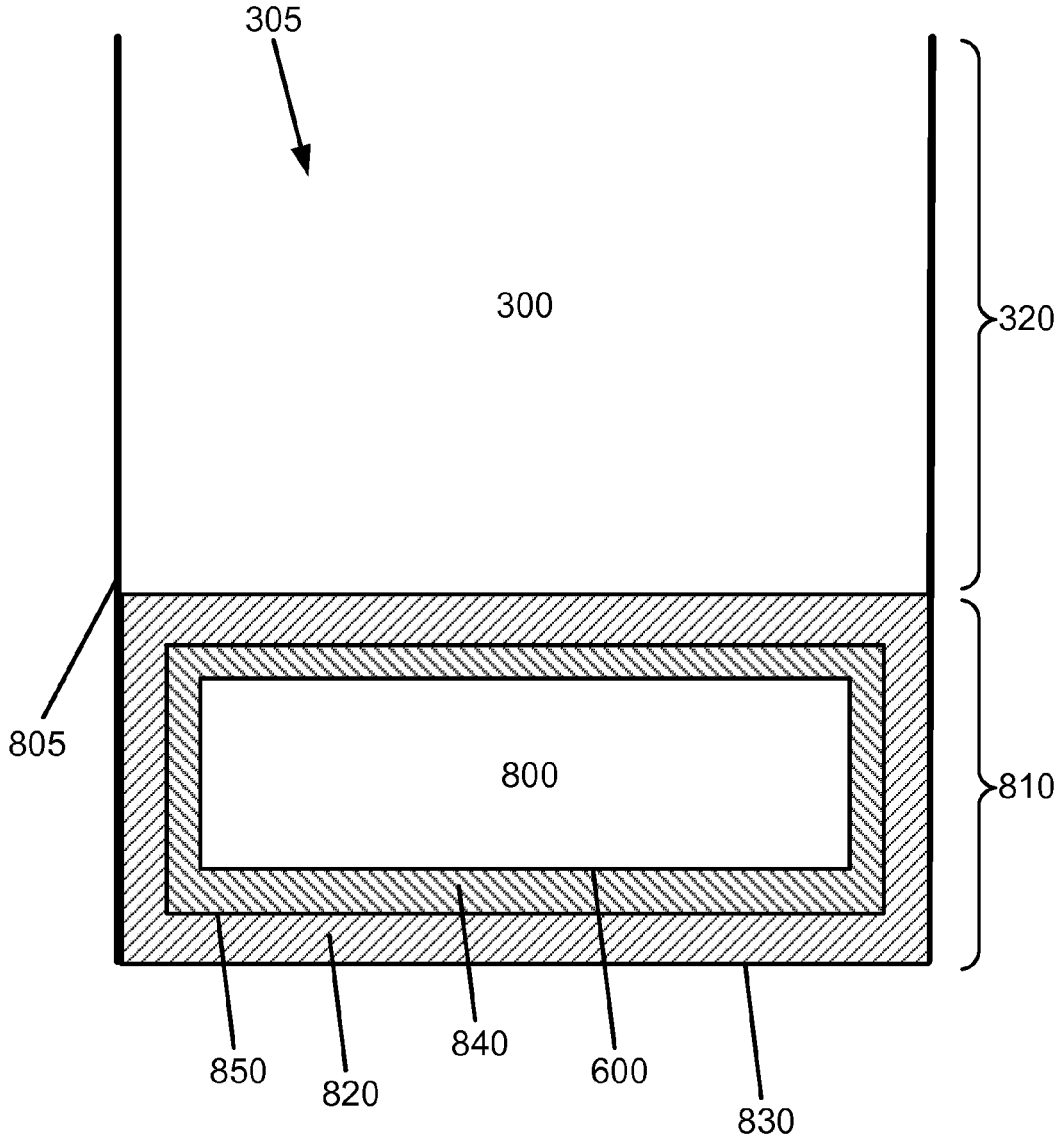
FIG. 8 is a schematic of a region of a refrigeration device.

FIG. 8 depicts an aspect of a refrigeration device in a substantially cross-section view. For purposes of illustration, FIG. 8 shows portions of a refrigeration device that can be incorporated with other features described herein. FIG. 8 depicts a liquid-impermeable container 300 including substantially planar walls 320. The interior of the liquid-impermeable container 300 includes a region 305 of a size and shape to form a space adjacent to a set of refrigeration coils. The exterior vertical walls of the substantially planar walls 320 of the liquid-impermeable container 300 are thermally conductive walls 805. The thermally conductive walls 805, in combination with a lower exterior wall 830 and the lower wall of the liquid-impermeable container 300, form an enclosure 810. Positioned within the enclosure 810 at a position adjacent to the walls of the enclosure 810, there is an insulating layer 820. A frame 600 of a size and shape to enclose one or more containers for frozen phase change material is positioned within the insulating layer 820. In the embodiment illustrated, an interior wall 850 divides the insulating layer from a layer of phase change material 840 positioned between the insulating layer 820 and the frame 600. In an embodiment, the system is integrated in such a manner that the system operates as a unique system configured specifically for function of the refrigeration device, and any associated computing devices of the system operate as specific use computers for purposes of the claimed system, and not general use computers. In an embodiment, at least one associated computing device of the system operate as specific use computers for purposes of the claimed system, and not general use computers. In an embodiment, at least one of the associated computing devices of the system are hardwired with a specific ROM to instruct the at least one computing device. In an embodiment, one of skill in the art recognizes that the refrigeration device and system effects an improvement at least in the technological field of refrigeration based on intermittent power sources, such as in remote or resource challenged regions.

This disclosure has been made with reference to various example embodiments. However, those skilled in the art will recognize that changes and modifications may be made to the embodiments without departing from the scope of the present disclosure. For example, various operational steps, as well as components for carrying out operational steps, may be implemented in alternate ways depending upon the particular application or in consideration of any number of cost functions associated with the operation of the system; e.g., one or more of the steps may be deleted, modified, or combined with other steps.

Additionally, principles of the present disclosure, including components, may be reflected in a computer program product on a computer-readable storage medium having computer-readable program code means embodied in the storage medium. Any tangible, non-transitory computer-readable storage medium may be utilized, including magnetic storage devices (hard disks, floppy disks, and the like), optical storage devices (CD-ROMs, DVDs, Blu-ray discs, and the like), flash memory, and/or the like. These computer program instructions may be loaded onto a general purpose computer, special purpose computer, or other programmable data processing apparatus to produce a machine, such that the instructions that execute on the computer or other programmable data processing apparatus create a means for implementing the functions specified. For example, the computer program instructions can be integrated into the circuitry of a controller of an embodiment of the refrigeration device. These computer program instructions may also be stored in a computer-readable memory that can direct a computer or other programmable data processing apparatus to function in a particular manner, such that the instructions stored in the computer-readable memory produce an article of manufacture, including implementing means that implement the function specified. The computer program instructions may also be loaded onto a computer or other programmable data processing apparatus to cause a series of operational steps to be performed on the computer or other programmable apparatus to produce a computer-implemented process, such that the instructions that execute on the computer or other programmable apparatus provide steps for implementing the functions specified.

In a general sense, various aspects described herein can be implemented, individually and/or collectively, by a wide range of hardware, software (e.g., a high-level computer program serving as a hardware specification), firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). The subject matter described herein may be implemented in an analog or digital fashion or some combination thereof.

The herein specification has been described with reference to various embodiments. However, various modifications and changes can be made without departing from the scope of the present disclosure. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. As used herein, the terms "comprises," "comprising," and any other variation thereof are intended to cover a non-exclusive inclusion, such that a process, a method, an article, or an apparatus that comprises a list of elements does not include only those elements but may include other elements not expressly listed or inherent to such process, method, system, article, or apparatus.

Aspects of the subject matter described herein are set out in the following numbered clauses:

1. A refrigeration device can include: one or more walls substantially forming a liquid-impermeable container, the liquid-impermeable container configured to hold phase change material internal to a refrigeration device; at least one active refrigeration unit including a set of evaporator coils, the evaporator coils positioned within an interior of the liquid-impermeable container; one or more walls substantially forming a storage region; and a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector with a hollow interior affixed to both the condenser and the evaporator, the connector forming a liquid and vapor flow path between the hollow interior of the condenser and the hollow interior of the evaporator.
2. The refrigeration device of paragraph 1, wherein the liquid-impermeable container is positioned above the storage region in the refrigeration device.
3. The refrigeration device of paragraph 1, wherein the liquid-impermeable container includes: an aperture of a size, shape and position to permit the set of evaporator coils to traverse the aperture; and a liquid-impermeable seal between a surface of the aperture and a surface of the set of evaporator coils.
4. The refrigeration device of paragraph 1, wherein the one or more walls substantially forming a liquid-impermeable container include a plurality of layers and the condenser is positioned adjacent to a surface of at least one of the plurality of layers.
5. The refrigeration device of paragraph 1, wherein the one or more walls substantially forming the liquid-impermeable container include a plurality of layers wherein at least one of the one or more layers includes non-planar regions to form multiple sides of the liquid-impermeable container.
6. The refrigeration device of paragraph 1, wherein the one or more walls substantially forming the storage region include an aperture of a position, size and shape to form an access opening.
7. The refrigeration device of paragraph 1, wherein the one or more walls substantially forming the storage region include an aperture of a position, size and shape to reversibly mate with a door.
8. The refrigeration device of paragraph 1, wherein the one or more walls substantially forming the storage region form five sides of a cuboid structure.
9. The refrigeration device of paragraph 1, wherein the one or more walls substantially forming the storage region include a plurality of layers and the evaporator is positioned adjacent to a surface of at least one of the plurality of layers.
10. The refrigeration device of paragraph 1, wherein the at least one active refrigeration unit includes an active refrigeration system.
11. The refrigeration device of paragraph 1, wherein the at least one active refrigeration unit includes an electrically powered compression system.
12. The refrigeration device of paragraph 1, wherein the at least one active refrigeration unit including the set of evaporator coils includes: a first section of the set of evaporator coils positioned adjacent to an exterior surface of the one or more walls substantially forming the liquid-impermeable container; a second section of the set of evaporator coils positioned within the interior of the liquid-impermeable container; and a frame of a size and shape to enclose one or more containers for frozen phase change material, the frame in thermal contact with the first section of the set of evaporator coils.
13. The refrigeration device of paragraph 1, wherein the heat transfer system forms a unidirectional thermal conductor within the refrigeration device.
14. The refrigeration device of paragraph 1, wherein the heat transfer system includes a contiguous substantially sealed hollow interior, and an evaporative liquid sealed within the contiguous substantially sealed hollow interior.
15. The refrigeration device of paragraph 1, wherein the first group of vapor-impermeable structures with the hollow interior connected to form the condenser form a branched structure.
16. The refrigeration device of paragraph 1, wherein the first group of vapor-impermeable structures with the hollow interior connected to form the condenser are integral to at least one of the one or more walls of the liquid-impermeable container.
17. The refrigeration device of paragraph 1, wherein the first group of vapor-impermeable structures with the hollow interior connected to form the condenser are in direct thermal contact with at least one of the one or more walls of the liquid-impermeable container.
18. The refrigeration device of paragraph 1, wherein the second group of vapor-impermeable structures with the hollow interior connected to form the evaporator form a branched structure.
19. The refrigeration device of paragraph 1, wherein the second group of vapor-impermeable structures with the hollow interior connected to form the evaporator are integral to at least one of the one or more walls of the liquid-impermeable container.
20. The refrigeration device of paragraph 1, wherein the second group of vapor-impermeable structures with the hollow interior connected to form the evaporator are in direct thermal contact with at least one of the one or more walls of the liquid-impermeable container.
21. The refrigeration device of paragraph 1, wherein the connector is a substantially linear structure positioned to be substantially vertical when the refrigeration device is in a position for use.
22. The refrigeration device of paragraph 1, wherein the connector includes multiple conduits with a first end affixed to the evaporator and a second end affixed to the condenser, and wherein each conduit is positioned and configured to provide a bidirectional flow path for liquid and vapor between the interior of the evaporator and the interior of the condenser.
23. The refrigeration device of paragraph 1, further including a phase-change material positioned within the liquid-impermeable container.
24. The refrigeration device of paragraph 1, further including an access lid within a top surface of the liquid-impermeable container, the access lid configured for a user to access an interior of the liquid-impermeable container.
25. The refrigeration device of paragraph 1, further including at least one valve connected to the connector, the valve positioned and configured to reversibly control size of the hollow interior of the connector.

26. The refrigeration device of paragraph 1, further including: at least one sensor positioned within the liquid-impermeable container between the one or more walls and the set of evaporator coils; and a controller operably attached to the at least one active refrigeration unit and to the sensor.
27. The refrigeration device of paragraph 26, wherein the controller includes circuitry for turning the at least one active refrigeration unit on and off in response to data received from the sensor.
28. The refrigeration device of paragraph 1, further including: a thermal control device connected to the connector, the thermal control device positioned and configured to reversibly control size of the hollow interior of the connector; at least one sensor positioned within the liquid-impermeable container between the one or more walls and the set of evaporator coils; and a controller operably attached to the thermal control device and to the sensor.
29. The refrigeration device of paragraph 28, wherein the controller includes circuitry for sending a control signal to the thermal control device in response to data received from the sensor.
30. The refrigeration device of paragraph 1, further including: a frame affixed to an exterior surface of the one or more walls substantially forming the liquid-impermeable container at a position distal to the condenser, the frame of a size and shape to enclose one or more containers for frozen phase change material; and at least one tensioner within the frame, the tensioner oriented to press the one or more containers against the one or more walls.
31. The refrigeration device of paragraph 30, wherein the frame includes at least one positioning element, the positioning element oriented to assist in positioning the one or more containers for frozen phase change material adjacent to the exterior surface of the one or more walls.
32. The refrigeration device of paragraph 30, wherein the frame is positioned within a second liquid-impermeable container.
33. The refrigeration device of paragraph 1, further including: a shell surrounding the liquid-impermeable container, the set of evaporator coils, the one or more walls substantially forming a storage region and the heat transfer system; and a door within the shell, the door positioned to reversibly permit a user to access the storage region.
34. The refrigeration device of paragraph 1, further including: a power monitor operably attached to the controller.
35. The refrigeration device of paragraph 1, further including: a thermally-conductive wall integral to the liquid-impermeable container, the thermally-conductive wall including a region projecting beyond an edge of the liquid-impermeable container; an enclosure affixed to the region of the thermally-conductive wall projecting beyond an edge of the liquid-impermeable container of the thermally-conductive wall, the enclosure including an insulating layer adjacent to the region of the thermally-conductive wall; and a frame affixed within the enclosure, the frame of a size and shape to enclose one or more containers for frozen phase change material.
36. A refrigeration device can include: one or more walls substantially forming a liquid-impermeable container, the container configured to hold phase change material internal to a refrigeration device, wherein the one or more walls integrally include a first group of vapor-impermeable structures with a hollow interior connected to form a condenser; at least one active refrigeration unit including a set of evaporator coils, the evaporator coils positioned within an interior of the liquid-impermeable container; one or more walls substantially forming a storage region and integrally including a second group of vapor-impermeable structures with a hollow interior connected to form a evaporator; and a connector affixed to both the condenser and the evaporator, the connector forming a liquid and vapor flow path between the hollow interior of the condenser and the hollow interior of the evaporator, wherein the condenser, the evaporator and the connector form a heat transfer system integral to the refrigeration device.
37. The refrigeration device of paragraph 36, wherein the liquid-impermeable container is positioned above the storage region in the refrigeration device.
38. The refrigeration device of paragraph 36, wherein the liquid-impermeable container includes: an aperture of a size, shape and position to permit the set of evaporator coils to traverse the aperture; and a liquid-impermeable seal between a surface of the aperture and a surface of the set of evaporator coils.
39. The refrigeration device of paragraph 36, wherein the one or more walls substantially forming a liquid-impermeable container include a plurality of layers and the condenser is positioned adjacent to a surface of at least one of the plurality of layers.
40. The refrigeration device of paragraph 36, wherein the one or more walls substantially forming the liquid-impermeable container include a plurality of layers wherein at least one of the one or more layers includes non-planar regions to form multiple sides of the liquid-impermeable container.
41. The refrigeration device of paragraph 36, wherein the first group of vapor-impermeable structures with the hollow interior connected to form the condenser form a branched structure.
42. The refrigeration device of paragraph 36, wherein the first group of vapor-impermeable structures with the hollow interior connected to form the condenser are integral to at least one of the one or more walls of the liquid-impermeable container.
43. The refrigeration device of paragraph 36, wherein the first group of vapor-impermeable structures with the hollow interior connected to form the condenser are in direct thermal contact with at least one of the one or more walls of the liquid-impermeable container.
44. The refrigeration device of paragraph 36, wherein the at least one active refrigeration unit includes an active refrigeration system.
45. The refrigeration device of paragraph 36, wherein the at least one active refrigeration unit includes an electrically powered compression system.
46. The refrigeration device of paragraph 36, wherein the at least one active refrigeration unit includes: a first section of the set of evaporator coils positioned adjacent to an exterior surface of the one or more walls substantially forming the liquid-impermeable container; a second section of the set of evaporator coils positioned within the interior of the liquid-impermeable container; and a frame of a size and shape to enclose one or more containers for frozen phase change material, the frame in thermal contact with the first section of the set of evaporator coils.
47. The refrigeration device of paragraph 36, wherein the one or more walls substantially forming the storage region include an aperture of a position, size and shape to form an access opening.
48. The refrigeration device of paragraph 36, wherein the one or more walls substantially forming the storage region include an aperture of a position, size and shape to reversibly mate with a door.

49. The refrigeration device of paragraph 36, wherein the one or more walls substantially forming the storage region form five sides of a cuboid structure.

50. The refrigeration device of paragraph 36, wherein the one or more walls substantially forming the storage region include a plurality of layers and the evaporator is positioned adjacent to a surface of at least one of the plurality of layers.

51. The refrigeration device of paragraph 36, wherein the second group of vapor-impermeable structures with the hollow interior connected to form the evaporator form a branched structure.

52. The refrigeration device of paragraph 36, wherein the second group of vapor-impermeable structures with the hollow interior connected to form the evaporator are integral to at least one of the one or more walls of the liquid-impermeable container.

53. The refrigeration device of paragraph 36, wherein the second group of vapor-impermeable structures with the hollow interior connected to form the evaporator are in direct thermal contact with at least one of the one or more walls of the liquid-impermeable container.

54. The refrigeration device of paragraph 36, wherein the connector is a substantially linear structure positioned to be substantially vertical when the refrigeration device is in a position for use.

55. The refrigeration device of paragraph 36, wherein the connector includes multiple conduits with a first end affixed to the evaporator and a second end affixed to the condenser, and wherein each conduit is positioned and configured to provide a bidirectional flow path for liquid and vapor between the interior of the evaporator and the interior of the condenser.

56. The refrigeration device of paragraph 36, wherein the heat transfer system forms a unidirectional thermal conductor within the refrigeration device.

57. The refrigeration device of paragraph 36, wherein the heat transfer system includes a contiguous substantially sealed hollow interior, and an evaporative liquid sealed within the contiguous substantially sealed hollow interior.

58. The refrigeration device of paragraph 36, further including a phase-change material positioned within the liquid-impermeable container.

59. The refrigeration device of paragraph 36, further including an access lid within a top surface of the liquid-impermeable container, the access lid configured for a user to access an interior of the liquid-impermeable container.

60. The refrigeration device of paragraph 36, further including at least one thermal control device connected to the connector, the thermal control device positioned and configured to reversibly control size of the hollow interior of the connector.

61. The refrigeration device of paragraph 36, further including: at least one sensor positioned within the liquid-impermeable container between the one or more walls and the set of evaporator coils; and a controller operably attached to the at least one active refrigeration unit and to the sensor.

62. The refrigeration device of paragraph 61, wherein the controller includes circuitry for turning the at least one active refrigeration unit on and off in response to data received from the sensor.

63. The refrigeration device of paragraph 36, further including: a thermal control device connected to the connector, the thermal control device positioned and configured to reversibly control size of the hollow interior of the connector; at least one sensor positioned within the liquid-impermeable container between the one or more walls and the set of evaporator coils; and a controller operably attached to the thermal control device and to the sensor.

64. The refrigeration device of paragraph 63, wherein the controller includes circuitry for sending a control signal to the thermal control device in response to data received from the sensor.

65. The refrigeration device of paragraph 36, further including: a frame affixed to an exterior surface of the one or more walls substantially forming the liquid-impermeable container at a position distal to the condenser, the frame of a size and shape to enclose one or more containers for frozen phase change material; and at least one tensioner within the frame, the tensioner oriented to press the one or more containers against the one or more walls.

66. The refrigeration device of paragraph 65, wherein the frame includes at least one positioning element, the positioning element oriented to assist in positioning the one or more containers for frozen phase change material adjacent to the exterior surface of the one or more walls.

67. The refrigeration device of paragraph 65, wherein the frame is positioned within a second liquid-impermeable container.

68. The refrigeration device of paragraph 36, further including: a shell surrounding the liquid-impermeable container, the set of evaporator coils, the one or more walls substantially forming a storage region and the heat transfer system; and a door within the shell, the door positioned to reversibly permit a user to access the storage region.

69. The refrigeration device of paragraph 36, further including: a power monitor operably attached to the controller.

70. The refrigeration device of paragraph 36, further including: a thermally-conductive wall integral to the liquid-impermeable container, the thermally-conductive wall including a region projecting beyond an edge of the liquid-impermeable container; an enclosure affixed to the region of the thermally-conductive wall projecting beyond an edge of the liquid-impermeable container of the thermally-conductive wall, the enclosure including an insulating layer adjacent to the region of the thermally-conductive wall; and a frame affixed within the enclosure, the frame of a size and shape to enclose one or more containers for frozen phase change material.

71. A refrigeration device can include: one or more walls substantially forming a liquid-impermeable container, the container configured to hold phase change material internal to a refrigeration device; at least one active refrigeration unit including a set of evaporator coils, the evaporator coils positioned within an interior of the liquid-impermeable container; a sensor positioned within the liquid-impermeable container between the one or more walls and the set of evaporator coils; one or more walls substantially forming a storage region; a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector affixed to both the condenser and the evaporator, the connector forming a liquid and vapor flow path between the hollow interior of the condenser and the hollow interior of the evaporator; and a controller operably attached to the at least one active refrigeration unit and to the sensor.

72. The refrigeration device of paragraph 71, wherein the liquid-impermeable container is positioned above the storage region in the refrigeration device.

73. The refrigeration device of paragraph 71, wherein the liquid-impermeable container includes: an aperture of a size, shape and position to permit the set of evaporator coils to traverse the aperture; and a liquid-impermeable seal between a surface of the aperture and a surface of the set of evaporator coils.

74. The refrigeration device of paragraph 71, wherein the one or more walls substantially forming a liquid-impermeable container include a plurality of layers and the condenser is positioned adjacent to a surface of at least one of the plurality of layers.

75. The refrigeration device of paragraph 71, wherein the one or more walls substantially forming the liquid-impermeable container include a plurality of layers wherein at least one of the one or more layers includes non-planar regions to form multiple sides of the liquid-impermeable container.

76. The refrigeration device of paragraph 71, wherein the at least one active refrigeration unit includes an active refrigeration system.

77. The refrigeration device of paragraph 71, wherein the at least one active refrigeration unit includes an electrically powered compression system.

78. The refrigeration device of paragraph 71, wherein the at least one active refrigeration unit including the set of evaporator coils includes: a first section of the set of evaporator coils positioned adjacent to an exterior surface of the one or more walls substantially forming the liquid-impermeable container; a second section of the set of evaporator coils positioned within the interior of the liquid-impermeable container; and a frame of a size and shape to enclose one or more containers for frozen phase change material, the frame in thermal contact with the first section of the set of evaporator coils.

79. The refrigeration device of paragraph 71, wherein the sensor positioned within the liquid-impermeable container between the one or more walls and the set of evaporator coils is positioned to be immersed in phase change material when the refrigeration device is in use.

80. The refrigeration device of paragraph 71, wherein the sensor positioned within the liquid-impermeable container between the one or more walls and the set of evaporator coils includes a temperature sensor.

81. The refrigeration device of paragraph 71, wherein the one or more walls substantially forming the storage region include an aperture of a position, size and shape to form an access opening.

82. The refrigeration device of paragraph 71, wherein the one or more walls substantially forming the storage region include an aperture of a position, size and shape to reversibly mate with a door.

83. The refrigeration device of paragraph 71, wherein the one or more walls substantially forming the storage region form five sides of a cuboid structure.

84. The refrigeration device of paragraph 71, wherein the one or more walls substantially forming the storage region include a plurality of layers and the evaporator is positioned adjacent to a surface of at least one of the plurality of layers.

85. The refrigeration device of paragraph 71, wherein the heat transfer system forms a unidirectional thermal conductor within the refrigeration device.

86. The refrigeration device of paragraph 71, wherein the heat transfer system includes a contiguous substantially sealed hollow interior, and an evaporative liquid sealed within the contiguous substantially sealed hollow interior.

87. The refrigeration device of paragraph 71, wherein the first group of vapor-impermeable structures with the hollow interior connected to form the condenser form a branched structure.

88. The refrigeration device of paragraph 71, wherein the first group of vapor-impermeable structures with the hollow interior connected to form the condenser are integral to at least one of the one or more walls of the liquid-impermeable container.

89. The refrigeration device of paragraph 71, wherein the first group of vapor-impermeable structures with the hollow interior connected to form the condenser are in direct thermal contact with at least one of the one or more walls of the liquid-impermeable container.

90. The refrigeration device of paragraph 71, wherein the second group of vapor-impermeable structures with the hollow interior connected to form the evaporator form a branched structure.

91. The refrigeration device of paragraph 71, wherein the second group of vapor-impermeable structures with the hollow interior connected to form the evaporator are integral to at least one of the one or more walls of the liquid-impermeable container.

92. The refrigeration device of paragraph 71, wherein the second group of vapor-impermeable structures with the hollow interior connected to form the evaporator are in direct thermal contact with at least one of the one or more walls of the liquid-impermeable container.

93. The refrigeration device of paragraph 71, wherein the connector is a substantially linear structure positioned to be substantially vertical when the refrigeration device is in a position for use.

94. The refrigeration device of paragraph 71, wherein the connector includes multiple conduits with a first end affixed to the evaporator and a second end affixed to the condenser, and wherein each conduit is positioned and configured to provide a bidirectional flow path for liquid and vapor between the interior of the evaporator and the interior of the condenser.

95. The refrigeration device of paragraph 71, wherein the controller includes circuitry for turning the at least one active refrigeration unit on and off in response to data received from the sensor.

96. The refrigeration device of paragraph 71, further including: a phase-change material positioned within the liquid-impermeable container.

97. The refrigeration device of paragraph 71, further including: an access lid within a top surface of the liquid-impermeable container, the access lid configured for a user to access an interior of the liquid-impermeable container.

98. The refrigeration device of paragraph 71, further including: at least one thermal control device connected to the connector, the thermal control device positioned and configured to reversibly control size of the hollow interior of the connector.

99. The refrigeration device of paragraph 71, further including: a thermal control device connected to the connector, the thermal control device positioned and configured to reversibly control size of the hollow interior of the connector, the thermal control device operably attached to the controller and configured to receive control signals from the controller.

100. The refrigeration device of paragraph 71, further including: a frame affixed to an exterior surface of the one or more walls substantially forming the liquid-impermeable container at a position distal to the condenser, the frame of a size and shape to enclose one or more containers for frozen phase change material; and at least one tensioner within the frame, the tensioner oriented to press the one or more containers against the one or more walls.

101. The refrigeration device of paragraph 100, wherein the frame includes at least one positioning element, the positioning element oriented to assist in positioning the one or more containers for frozen phase change material adjacent to the exterior surface of the one or more walls.

102. The refrigeration device of paragraph 100, wherein the frame is positioned within a second liquid-impermeable container.

103. The refrigeration device of paragraph 71, further including: a shell surrounding the liquid-impermeable container, the set of evaporator coils, the one or more walls substantially forming a storage region and the heat transfer system; and a door within the shell, the door positioned to reversibly permit a user to access the storage region.

104. The refrigeration device of paragraph 71, further including: a power monitor operably attached to the controller.

105. The refrigeration device of c paragraph 71, further including: a thermally-conductive wall integral to the liquid-impermeable container, the thermally-conductive wall including a region projecting beyond an edge of the liquid-impermeable container; an enclosure affixed to the region of the thermally-conductive wall projecting beyond an edge of the liquid-impermeable container of the thermally-conductive wall, the enclosure including an insulating layer adjacent to the region of the thermally-conductive wall; and a frame affixed within the enclosure, the frame of a size and shape to enclose one or more containers for frozen phase change material.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A refrigeration device, comprising:

one or more walls substantially forming a liquid-impermeable container, the liquid-impermeable container configured to hold phase change material internal to a refrigeration device;

at least one active refrigeration unit including a set of evaporator coils, the evaporator coils positioned within an interior of the liquid-impermeable container;

one or more walls substantially forming a storage region; and a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector with a hollow interior affixed to both the condenser and the evaporator, the connector forming a liquid and vapor flow path between the hollow interior of the condenser and the hollow interior of the evaporator.

2. The refrigeration device of claim 1, wherein the one or more walls substantially forming a liquid-impermeable container include a plurality of layers and the condenser is positioned adjacent to a surface of at least one of the plurality of layers.

3. The refrigeration device of claim 1, wherein the one or more walls substantially forming the liquid-impermeable container include a plurality of layers wherein at least one of the one or more layers includes non-planar regions to form multiple sides of the liquid-impermeable container.

4. The refrigeration device of claim 1, wherein the one or more walls substantially forming the storage region include a plurality of layers and the evaporator is positioned adjacent to a surface of at least one of the plurality of layers.

5. The refrigeration device of claim 1, wherein the at least one active refrigeration unit including the set of evaporator coils comprises:

a first section of the set of evaporator coils positioned adjacent to an exterior surface of the one or more walls substantially forming the liquid-impermeable container;

a second section of the set of evaporator coils positioned within the interior of the liquid-impermeable container; and a frame of a size and shape to enclose one or more containers for frozen phase change material, the frame in thermal contact with the first section of the set of evaporator coils.

6. The refrigeration device of claim 1, wherein the first group of vapor-impermeable structures with the hollow interior connected to form the condenser are integral to at least one of the one or more walls of the liquid-impermeable container.

7. The refrigeration device of claim 1, wherein the second group of vapor-impermeable structures with the hollow interior connected to form the evaporator are integral to at least one of the one or more walls of the liquid-impermeable container.

8. The refrigeration device of claim 1, wherein the connector includes multiple conduits with a first end affixed to the evaporator and a second end affixed to the condenser, and wherein each conduit is positioned and configured to provide a bidirectional flow path for liquid and vapor between the interior of the evaporator and the interior of the condenser.

9. The refrigeration device of claim 1, further comprising:

at least one valve connected to the connector, the valve positioned and configured to reversibly control size of the hollow interior of the connector.

10. The refrigeration device of claim 1, further comprising:

at least one sensor positioned within the liquid-impermeable container between the one or more walls and the set of evaporator coils; and a controller operably attached to the at least one active refrigeration unit and to the sensor.

11. The refrigeration device of claim 1, further comprising:

a thermal control device connected to the connector, the thermal control device positioned and configured to reversibly control size of the hollow interior of the connector;

at least one sensor positioned within the liquid-impermeable container between the one or more walls and the set of evaporator coils; and a controller operably attached to the thermal control device and to the sensor.

12. The refrigeration device of claim 1, further comprising:

a frame affixed to an exterior surface of the one or more walls substantially forming the liquid-impermeable container at a position distal to the condenser, the frame of a size and shape to enclose one or more containers for frozen phase change material; and at least one tensioner within the frame, the tensioner oriented to press the one or more containers against the one or more walls.

13. The refrigeration device of claim 1, further comprising:

a power monitor operably attached to the controller.

14. The refrigeration device of claim 1, further comprising:

a thermally-conductive wall integral to the liquid-impermeable container, the thermally-conductive wall including a region projecting beyond an edge of the liquid-impermeable container;

an enclosure affixed to the region of the thermally-conductive wall projecting beyond an edge of the liquid-impermeable container of the thermally-conductive wall, the enclosure including an insulating layer adjacent to the region of the thermally-conductive wall; and a frame affixed within the enclosure, the frame of a size and shape to enclose one or more containers for frozen phase change material.

15. A refrigeration device, comprising:

one or more walls substantially forming a liquid-impermeable container, the container configured to hold phase change material internal to a refrigeration device, wherein the one or more walls integrally include a first group of vapor-impermeable structures with a hollow interior connected to form a condenser;

at least one active refrigeration unit including a set of evaporator coils, the evaporator coils positioned within an interior of the liquid-impermeable container;

one or more walls substantially forming a storage region and integrally including a second group of vapor-impermeable structures with a hollow interior connected to form a evaporator; and a connector affixed to both the condenser and the evaporator, the connector forming a liquid and vapor flow path between the hollow interior of the condenser and the hollow interior of the evaporator, wherein the condenser, the evaporator and the connector form a heat transfer system integral to the refrigeration device.

16. The refrigeration device of claim 15, wherein the one or more walls substantially forming a liquid-impermeable container include a plurality of layers and the condenser is positioned adjacent to a surface of at least one of the plurality of layers.

17. The refrigeration device of claim 15, wherein the one or more walls substantially forming the liquid-impermeable container include a plurality of layers wherein at least one of the one or more layers includes non-planar regions to form multiple sides of the liquid-impermeable container.

18. The refrigeration device of claim 15, wherein the first group of vapor-impermeable structures with the hollow interior connected to form the condenser form a branched structure.

19. The refrigeration device of claim 15, wherein the first group of vapor-impermeable structures with the hollow interior connected to form the condenser are integral to at least one of the one or more walls of the liquid-impermeable container.

20. The refrigeration device of claim 15, wherein the at least one active refrigeration unit comprises:

a first section of the set of evaporator coils positioned adjacent to an exterior surface of the one or more walls substantially forming the liquid-impermeable container;

a second section of the set of evaporator coils positioned within the interior of the liquid-impermeable container; and a frame of a size and shape to enclose one or more containers for frozen phase change material, the frame in thermal contact with the first section of the set of evaporator coils.

21. The refrigeration device of claim 15, wherein the one or more walls substantially forming the storage region form five sides of a cuboid structure.

22. The refrigeration device of claim 15, wherein the second group of vapor-impermeable structures with the hollow interior connected to form the evaporator form a branched structure.

23. The refrigeration device of claim 15, wherein the second group of vapor-impermeable structures with the hollow interior connected to form the evaporator are integral to at least one of the one or more walls of the liquid-impermeable container.

24. The refrigeration device of claim 15, wherein the connector includes multiple conduits with a first end affixed to the evaporator and a second end affixed to the condenser, and wherein each conduit is positioned and configured to provide a bidirectional flow path for liquid and vapor between the interior of the evaporator and the interior of the condenser.

25. The refrigeration device of claim 15, further comprising:

at least one sensor positioned within the liquid-impermeable container between the one or more walls and the set of evaporator coils; and a controller operably attached to the at least one active refrigeration unit and to the sensor.

26. The refrigeration device of claim 15, further comprising:

a thermal control device connected to the connector, the thermal control device positioned and configured to reversibly control size of the hollow interior of the connector;

at least one sensor positioned within the liquid-impermeable container between the one or more walls and the set of evaporator coils; and a controller operably attached to the thermal control device and to the sensor.

27. The refrigeration device of claim 15, further comprising:

a frame affixed to an exterior surface of the one or more walls substantially forming the liquid-impermeable container at a position distal to the condenser, the frame of a size and shape to enclose one or more containers for frozen phase change material; and at least one tensioner within the frame, the tensioner oriented to press the one or more containers against the one or more walls.

28. The refrigeration device of claim 15, further comprising:

a power monitor operably attached to the controller.

29. The refrigeration device of claim 15, further comprising:

a thermally-conductive wall integral to the liquid-impermeable container, the thermally-conductive wall including a region projecting beyond an edge of the liquid-impermeable container;

an enclosure affixed to the region of the thermally-conductive wall projecting beyond an edge of the liquid-impermeable container of the thermally-conductive wall, the enclosure including an insulating layer adjacent to the region of the thermally-conductive wall; and a frame affixed within the enclosure, the frame of a size and shape to enclose one or more containers for frozen phase change material.

30. A refrigeration device, comprising:

one or more walls substantially forming a liquid-impermeable container, the container configured to hold phase change material internal to a refrigeration device;

at least one active refrigeration unit including a set of evaporator coils, the evaporator coils positioned within an interior of the liquid-impermeable container;

a sensor positioned within the liquid-impermeable container between the one or more walls and the set of evaporator coils;

one or more walls substantially forming a storage region;

a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector affixed to both the condenser and the evaporator, the connector forming a liquid and vapor flow path between the hollow interior of the condenser and the hollow interior of the evaporator; and a controller operably attached to the at least one active refrigeration unit and to the sensor.

31. The refrigeration device of claim 30, wherein the one or more walls substantially forming a liquid-impermeable container include a plurality of layers and the condenser is positioned adjacent to a surface of at least one of the plurality of layers.

32. The refrigeration device of claim 30, wherein the one or more walls substantially forming the liquid-impermeable container include a plurality of layers wherein at least one of the one or more layers includes non-planar regions to form multiple sides of the liquid-impermeable container.

33. The refrigeration device of claim 30, wherein the at least one active refrigeration unit including the set of evaporator coils comprises:

a first section of the set of evaporator coils positioned adjacent to an exterior surface of the one or more walls substantially forming the liquid-impermeable container;

a second section of the set of evaporator coils positioned within the interior of the liquid-impermeable container; and a frame of a size and shape to enclose one or more containers for frozen phase change material, the frame in thermal contact with the first section of the set of evaporator coils.

34. The refrigeration device of claim 30, wherein the sensor positioned within the liquid-impermeable container between the one or more walls and the set of evaporator coils is positioned to be immersed in phase change material when the refrigeration device is in use.

35. The refrigeration device of claim 30, wherein the sensor positioned within the liquid-impermeable container between the one or more walls and the set of evaporator coils comprises:

a temperature sensor.

36. The refrigeration device of claim 30, wherein the first group of vapor-impermeable structures with the hollow interior connected to form the condenser are integral to at least one of the one or more walls of the liquid-impermeable container.

37. The refrigeration device of claim 30, wherein the second group of vapor-impermeable structures with the hollow interior connected to form the evaporator are integral to at least one of the one or more walls of the liquid-impermeable container.

38. The refrigeration device of claim 30, wherein the connector includes multiple conduits with a first end affixed to the evaporator and a second end affixed to the condenser, and wherein each conduit is positioned and configured to provide a bidirectional flow path for liquid and vapor between the interior of the evaporator and the interior of the condenser.

39. The refrigeration device of claim 30, further comprising:

at least one thermal control device connected to the connector, the thermal control device positioned and configured to reversibly control size of the hollow interior of the connector.

40. The refrigeration device of claim 30, further comprising:

a frame affixed to an exterior surface of the one or more walls substantially forming the liquid-impermeable container at a position distal to the condenser, the frame of a size and shape to enclose one or more containers for frozen phase change material; and at least one tensioner within the frame, the tensioner oriented to press the one or more containers against the one or more walls.

41. The refrigeration device of claim 40, wherein the frame is positioned within a second liquid-impermeable container.

42. The refrigeration device of claim 30, further comprising:

a power monitor operably attached to the controller.

43. The refrigeration device of claim 30, further comprising:

a thermally-conductive wall integral to the liquid-impermeable container, the thermally-conductive wall including a region projecting beyond an edge of the liquid-impermeable container;

an enclosure affixed to the region of the thermally-conductive wall projecting beyond an edge of the liquid-impermeable container of the thermally-conductive wall, the enclosure including an insulating layer adjacent to the region of the thermally-conductive wall; and a frame affixed within the enclosure, the frame of a size and shape to enclose one or more containers for frozen phase change material.

* * * * *